US007681502B2

(12) United States Patent
Huang

(10) Patent No.: US 7,681,502 B2
(45) Date of Patent: Mar. 23, 2010

(54) STYLING PYROTECHNIC DEVICE

(76) Inventor: Chao-Chen Huang, No. 5, Alley 2, Lane 93, Sec. 3, Jinling Rd., Pingjhen City, Taoyuan County (TW)

( * ) Notice: Subject to any disclaimer, the term of this patent is extended or adjusted under 35 U.S.C. 154(b) by 56 days.

(21) Appl. No.: 11/798,053

(22) Filed: May 9, 2007

(65) Prior Publication Data

US 2008/0276820 A1 Nov. 13, 2008

(51) Int. Cl.
*F42B 4/20* (2006.01)

(52) U.S. Cl. ..... 102/358

(58) Field of Classification Search ..... 102/360, 102/335, 358, 349; 211/60.1, 62, 67, 68, 211/70.4

See application file for complete search history.

(56) References Cited

U.S. PATENT DOCUMENTS 1,922,156 A * 8/1933 Achillo ..... 102/357
2,053,454 A * 9/1936 Whiteside ..... 248/524
2,103,936 A * 12/1937 Decker ..... 102/357
3,905,324 A * 9/1975 English ..... 116/63 P
4,063,485 A * 12/1977 Carter et al. ..... 89/1.816
4,771,695 A * 9/1988 Simpson ..... 102/343
5,380,568 A * 1/1995 Banschick ..... 428/4
5,429,053 A * 7/1995 Walker ..... 102/342
7,007,584 B2 * 3/2006 Caballer Barat ..... 89/1.816
7,011,220 B2 * 3/2006 Deye ..... 211/60.1
7,314,005 B2 * 1/2008 Deye ..... 102/356
2005/0092622 A1 * 5/2005 Whitley ..... 206/3
2008/0006168 A1 * 1/2008 Huang ..... 102/358

* cited by examiner

*Primary Examiner*—Michael Carone
*Assistant Examiner*—Reginald Tillman, Jr.
(74) *Attorney, Agent, or Firm*—Jackson IPG PLLC

(57) ABSTRACT

A styling pyrotechnic device comprising multiple, two preferred, bearing members with each disposed with multiple locating holes to receive insertion of multiple pyrotechnic tubes; each pyrotechnic tube being erected at a certain inclination; multiple locating holes on each bearing member being arranged in a circle; each circle having its circumference same as or different from that of another circle for multiple pyrotechnic tubes to be erected at different inclinations to produce various styling effects when fired into the skies.

8 Claims, 28 Drawing Sheets

STYLING PYROTECHNIC DEVICE

BACKGROUND OF THE INVENTION (a) Field of the Invention

The present invention is related to a styling pyrotechnic device to shoot multiple tubes each packed with explosive and arranged at different angles for producing various types of styling effects when launched into the skies.

(b) Description of the Prior Art

A conventional pyrotechnic device is essentially comprised of base, launching barrel, and ignition cord as disclosed in utility patents published in Taiwan Patent Gazette No. 347074 titled "Assembly of Sealing Layer of Fireworks Launching Barrel", No. 419056, "Fireworks Launching Stand", and No. 496515, "Improved Construction of Fireworks Launching Barrel".

Referring to FIG. 1 of the accompanying drawing for a perspective view of an explosive pyrotechnic device of the prior art, multiple fireworks tubes 12 are vertically arranged on a base 11 and are connected by means of an ignition cord 13 penetrating through a lower end of each tube 12, and the ignition cord 13 is led out and extends from the base 11 to become a blasting fuse 14 to ignite those fireworks tubes 12. Accordingly, other than colored flames and sparks, fireworks when launched into the skies fail to create special effects of showing aesthetic forms since they are fired straight up into the skies and can not create larger scope of colored flames and sparks in radiant fashion.

SUMMARY OF THE INVENTION

The primary purpose of the present invention is to provide an improved structure of a pyrotechnic device that allows multiple pyrotechnic tubes each packed with explosives to be arranged at different angles from one another to that when fired into the skies they produce styling effects.

To achieve the purpose, two or more than two bearing members are provided with each disposed with multiple locating holes to be inserted with multiple pyrotechnic tubes; and all locating holes are erected at an inclination or arranged in circles with different sizes of circumferences so that once those pyrotechnic tubes are fired into the skies, they can display various styling effects.

DETAILED DESCRIPTION OF THE PREFERRED EMBODIMENTS

Figure 1:
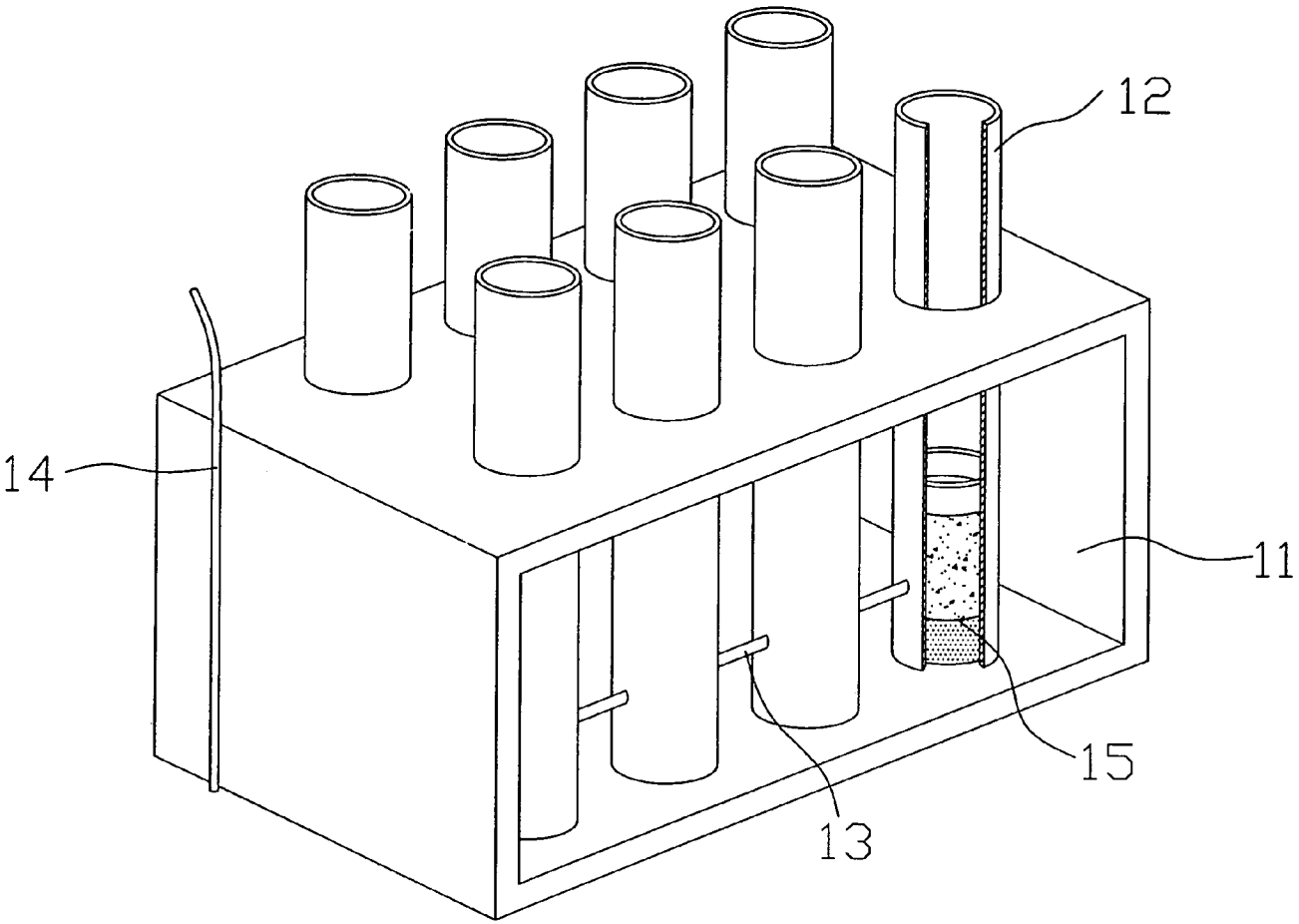
FIG.1 PRIOR ART
FIG. 1 is a perspective view showing an explosive pyrotechnic device of the prior art.
Figure 2A:
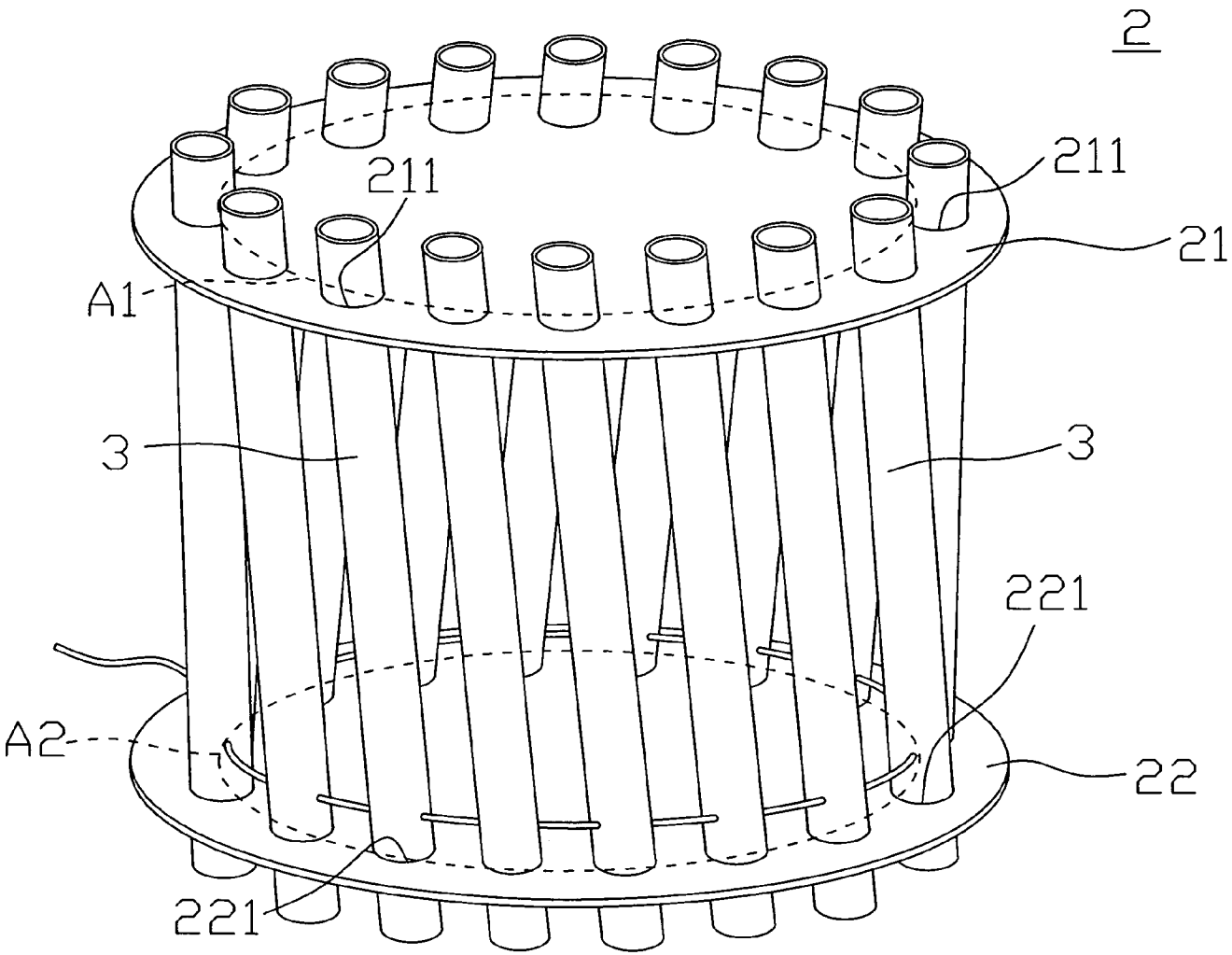
FIGS. 2 (A) and 2 (B) are respectively a perspective view and a schematic view of a first preferred embodiment of the present invention.
Figure 2B:
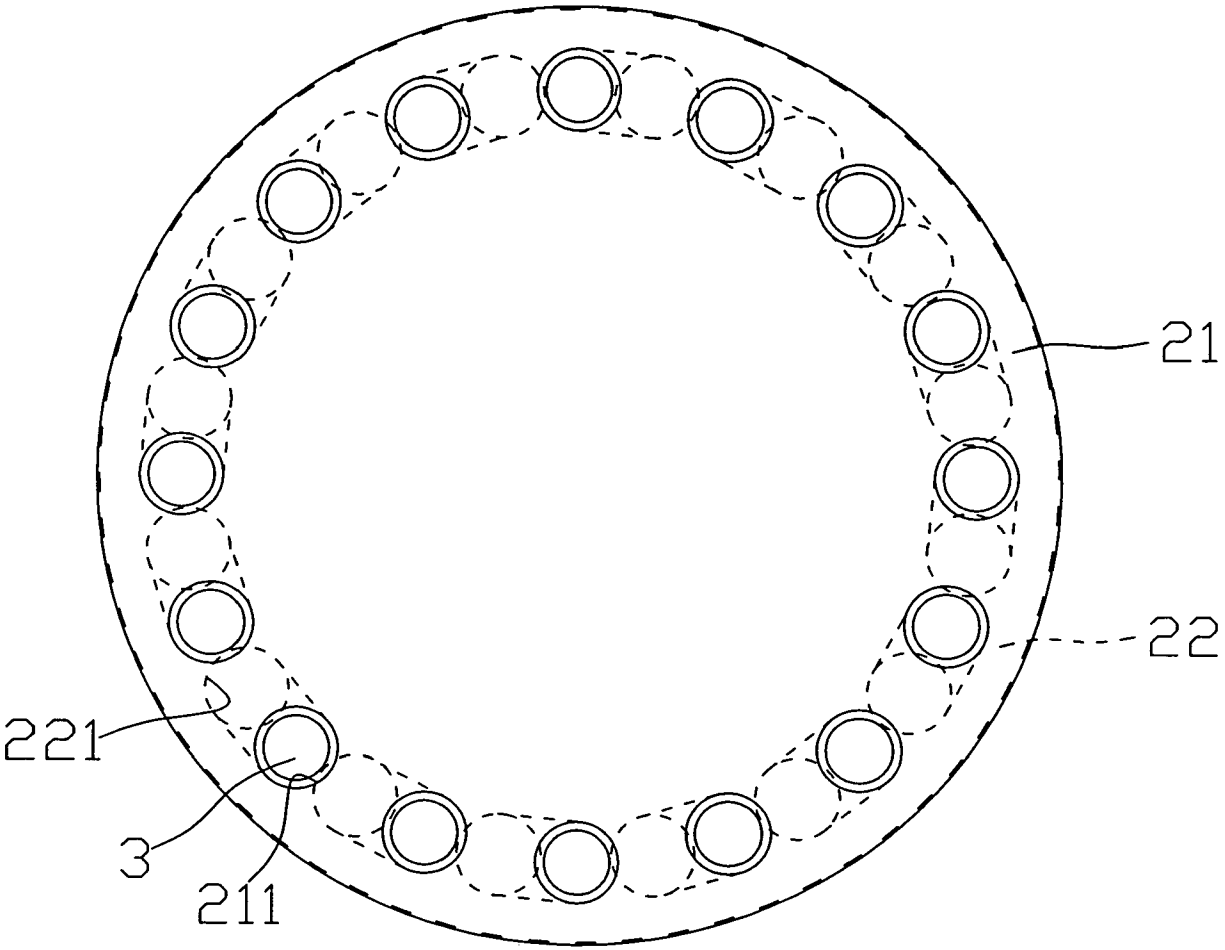

A styling pyrotechnic device of the present invention is disposed with two or more than two bearing members. Referring to FIG. 2(A) for a first preferred embodiment of the present invention, a styling pyrotechnic device 2 is disposed with a first bearing member 21 and a second bearing member 22 with each including multiple bearing portions. Each bearing portion includes a first locating hole 211 on the first bearing member 21 and a second locating hole 221 on the second bearing member 22. Those bearing portions disposed on the first and the second bearing members respectively for a first circle A1 and a second circle A2. Both circumferences of the first and the second circles A1, A2 are identical. Each pyrotechnic tube 3 is inserted first into the first locating hole 211 of the first bearing member 21 and then into the second locating hole 221 of the second bearing member 22 not directly on the same vertical line to the first locating hole but the one next to it; accordingly, each pyrotechnic tube 3 is erected at an inclined angle towards a single axis as illustrated in FIG. 2(B) so that once all pyrotechnic tubes 3 when fired into the skies produce various styling effects.

Figure 3A:
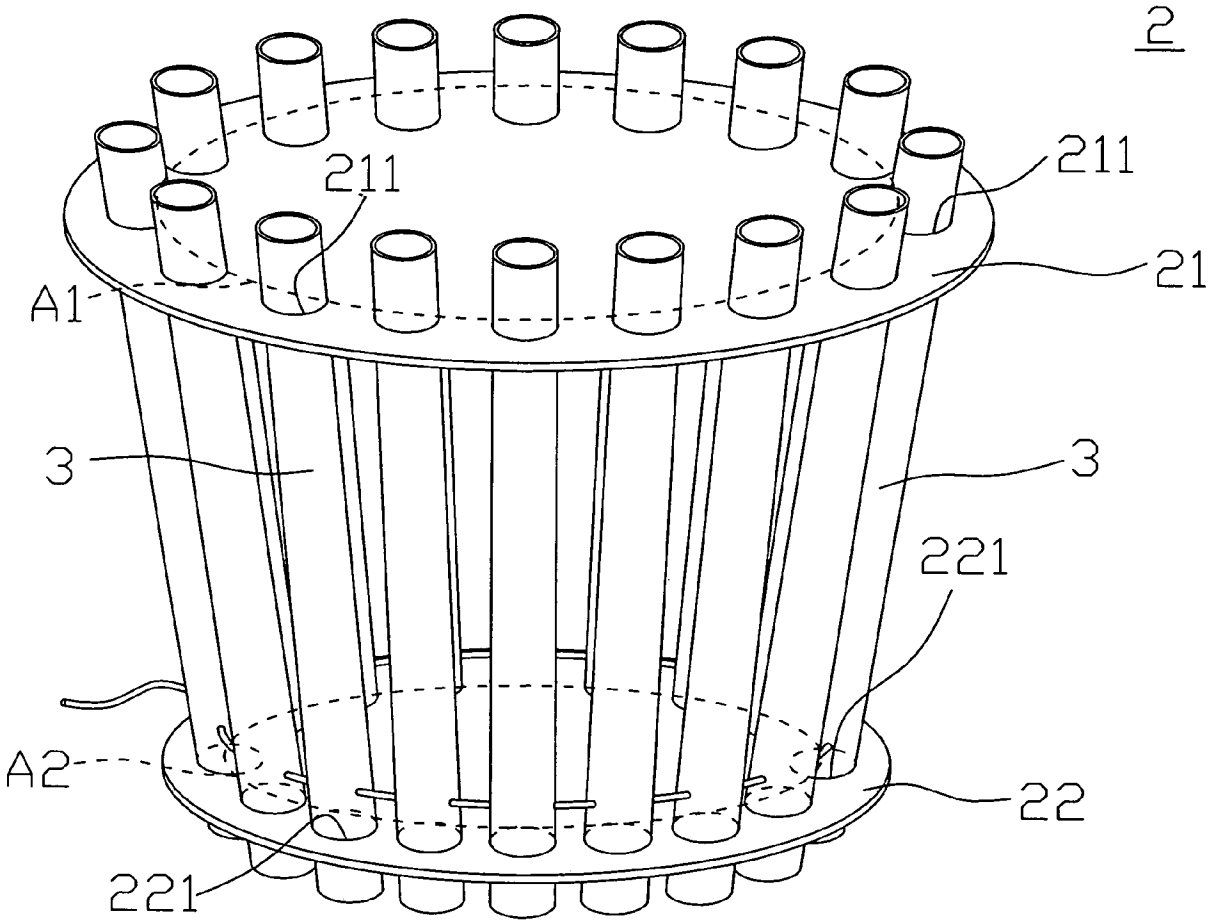
FIGS. 3 (A), 3(B), and 3(C) are respectively a perspective view and two schematic views of a second preferred embodiment of the present invention.
Figure 3B:
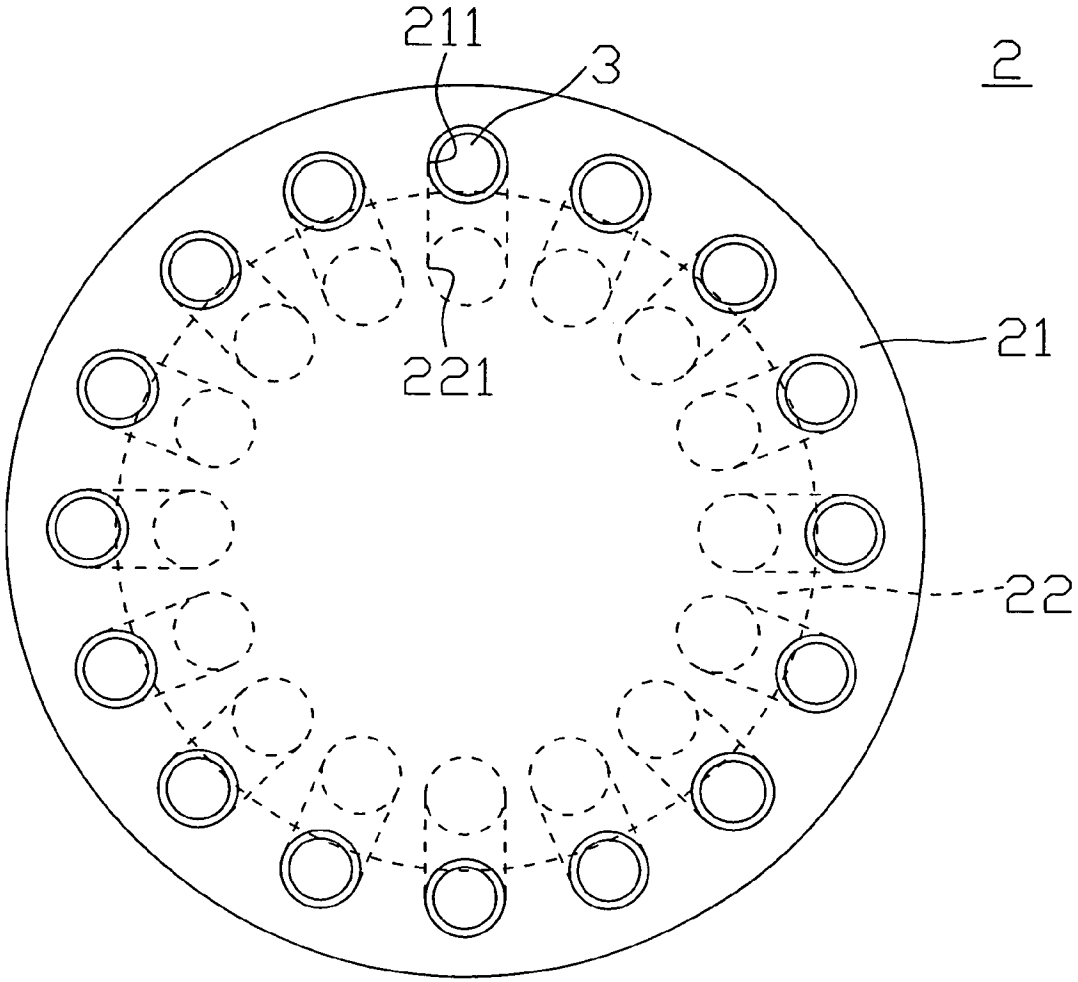
Figure 3C:
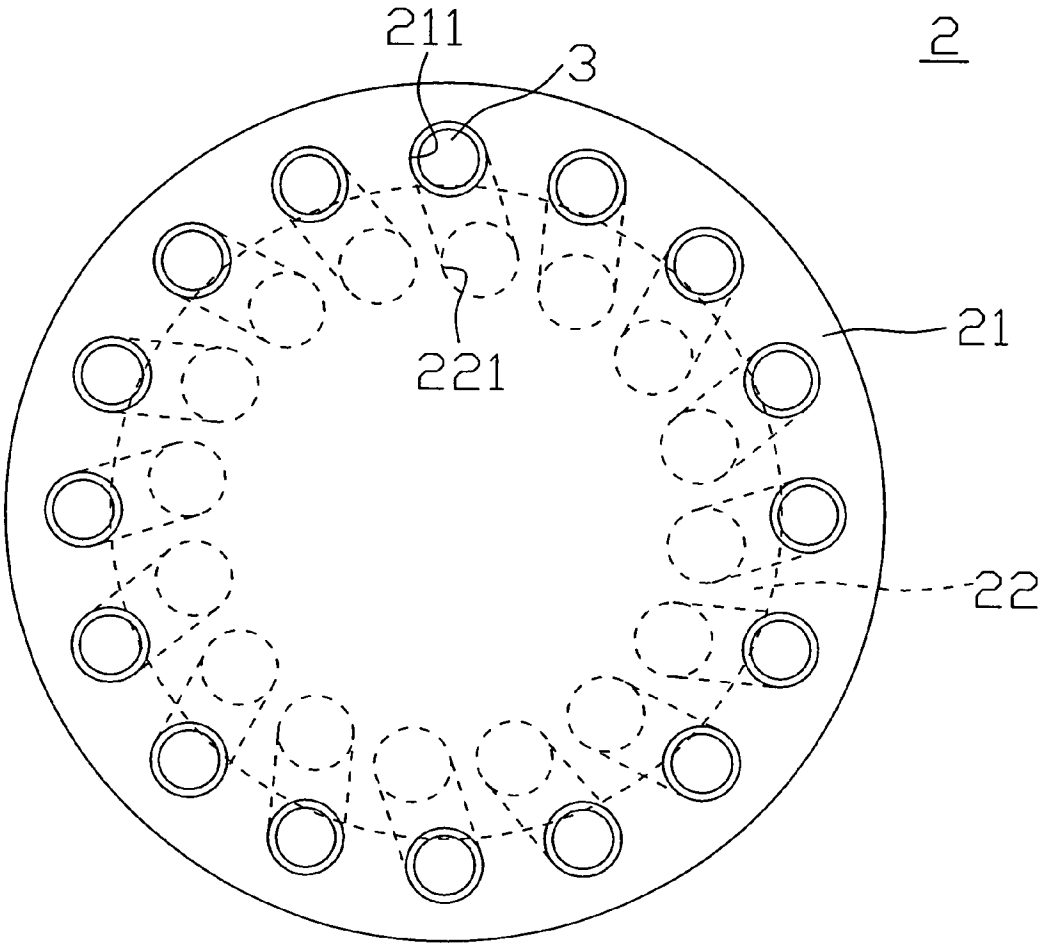

In a second preferred embodiment as illustrated in FIG. 3(A), a circumference of a first circle A1 arranged by multiple first locating holes 211 is greater than that of a second circle A2 arranged by multiple second locating holes 221 so that all pyrotechnic tubes 3 are each erected at an inclination toward a single axis as illustrated in FIG. 3 (B); or alternatively a first bearing member 21 or a second bearing member 22 is turned for a certain angle clockwise or counterclockwise as illustrated in FIG. 3(C) so that each pyrotechnic tube 3 is arranged at an inclination toward double axes.

Figure 4A:
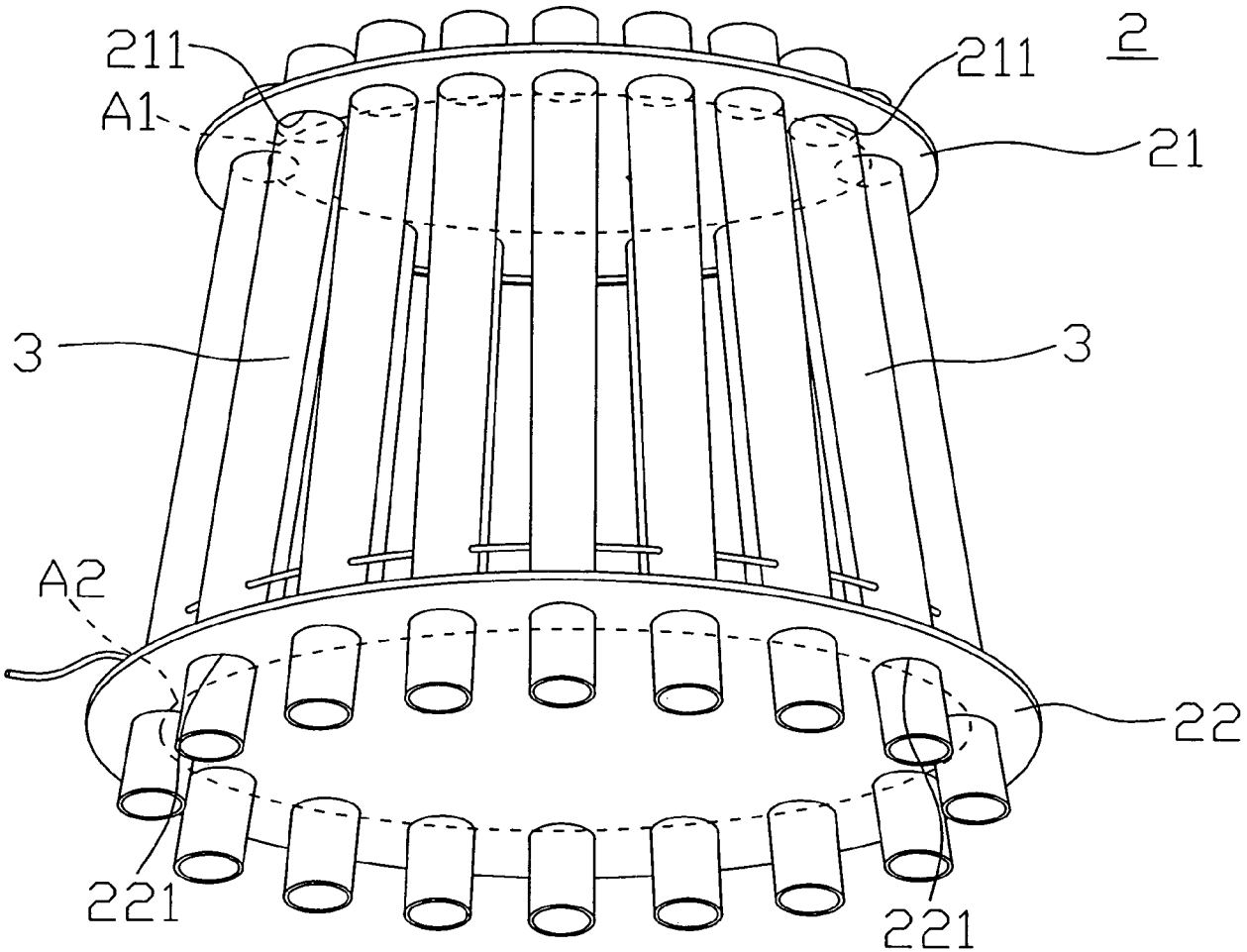
FIGS. 4 (A), 4(B), and 4(C) are respectively a perspective view and two schematic views of a third preferred embodiment of the present invention.
Figure 4B:
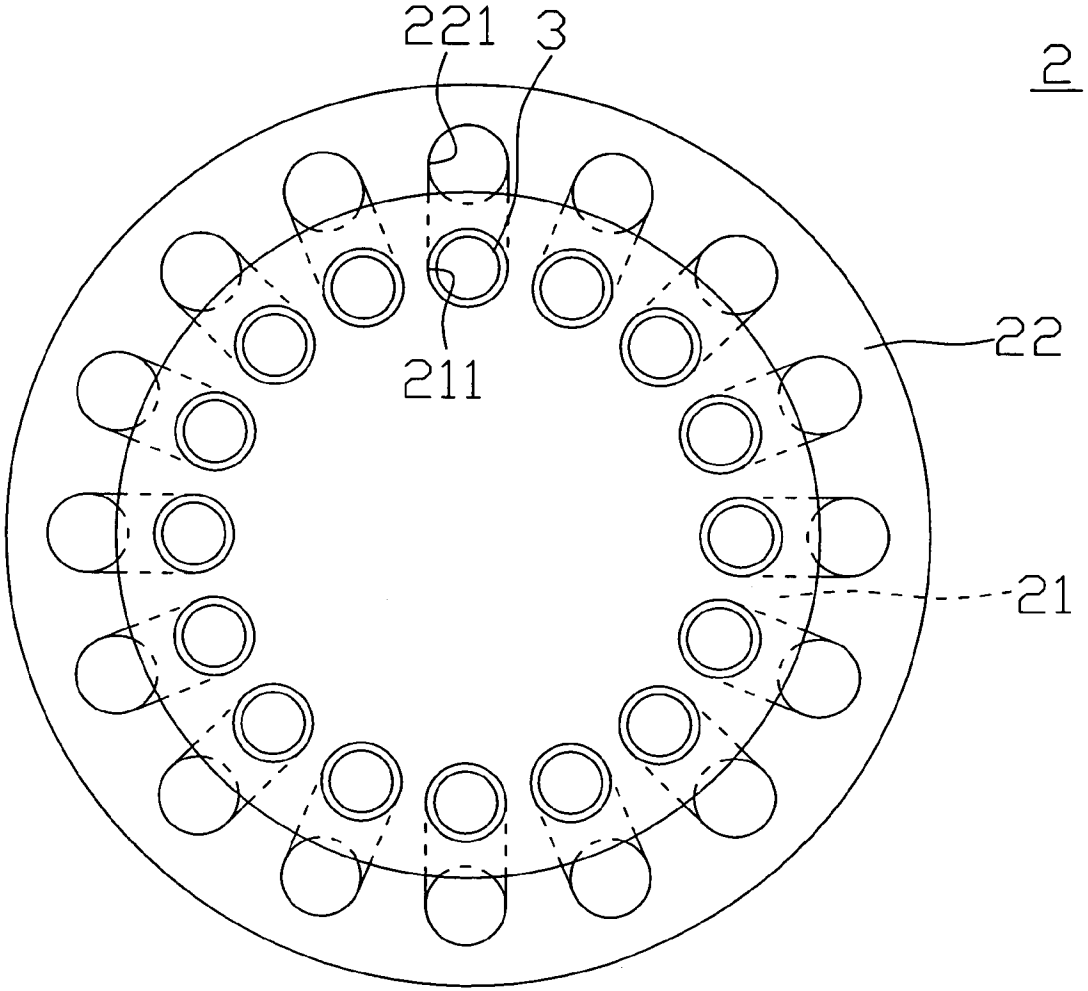
Figure 4C:
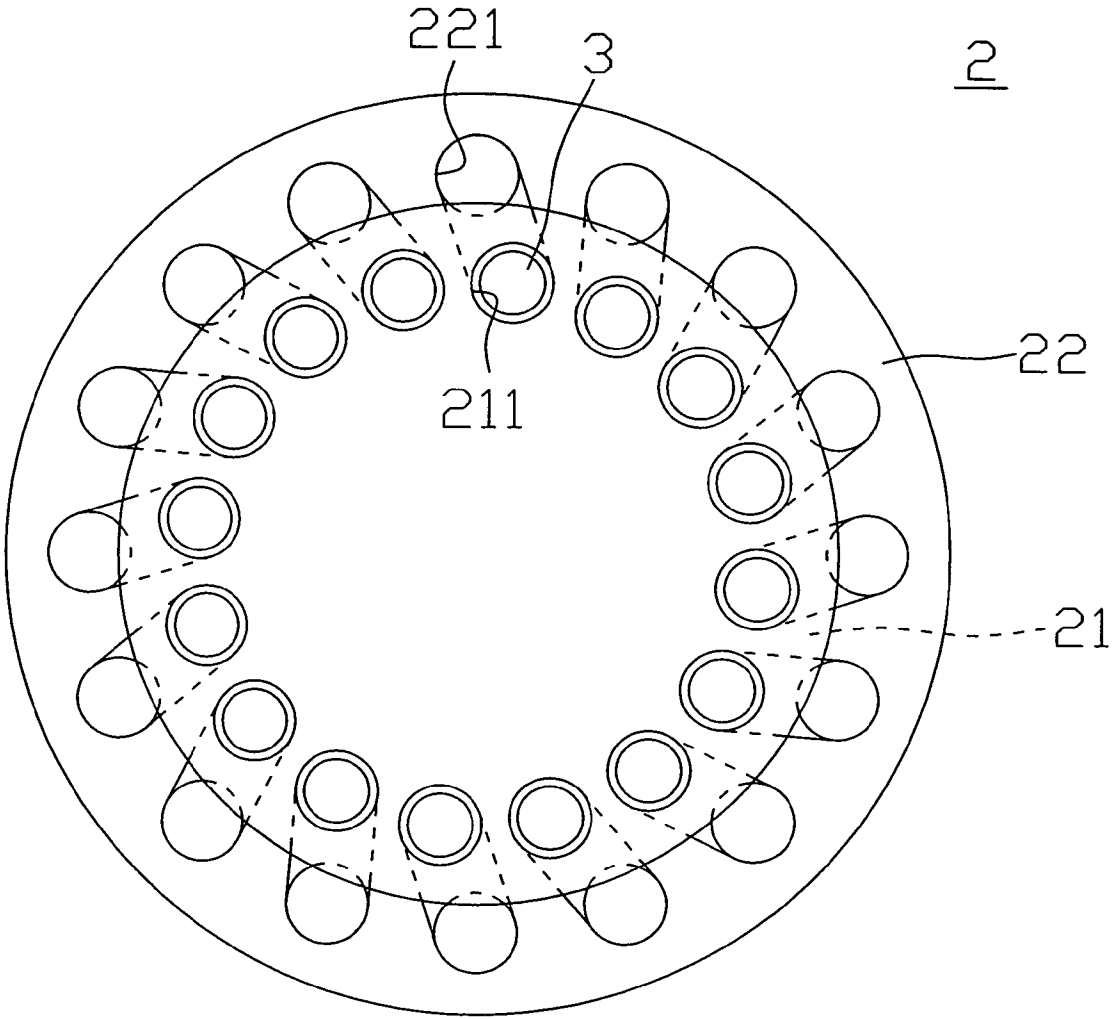

Now referring to FIG. 4(A) for a third preferred embodiment of the present invention, a circumference of a first circle A1 arranged by multiple first locating holes 211 is smaller than that of a second circle A2 for each of all pyrotechnic tubes 3 to be erected at a certain inclination toward a single axis as illustrated in FIG. 4 (B); or alternatively, a first bearing member 21 or a second bearing member 22 is turned for a certain angle clockwise or counterclockwise as illustrated in FIG. 4(C) so that each pyrotechnic tube 3 is arranged at an inclination toward double axes.

Figure 5:
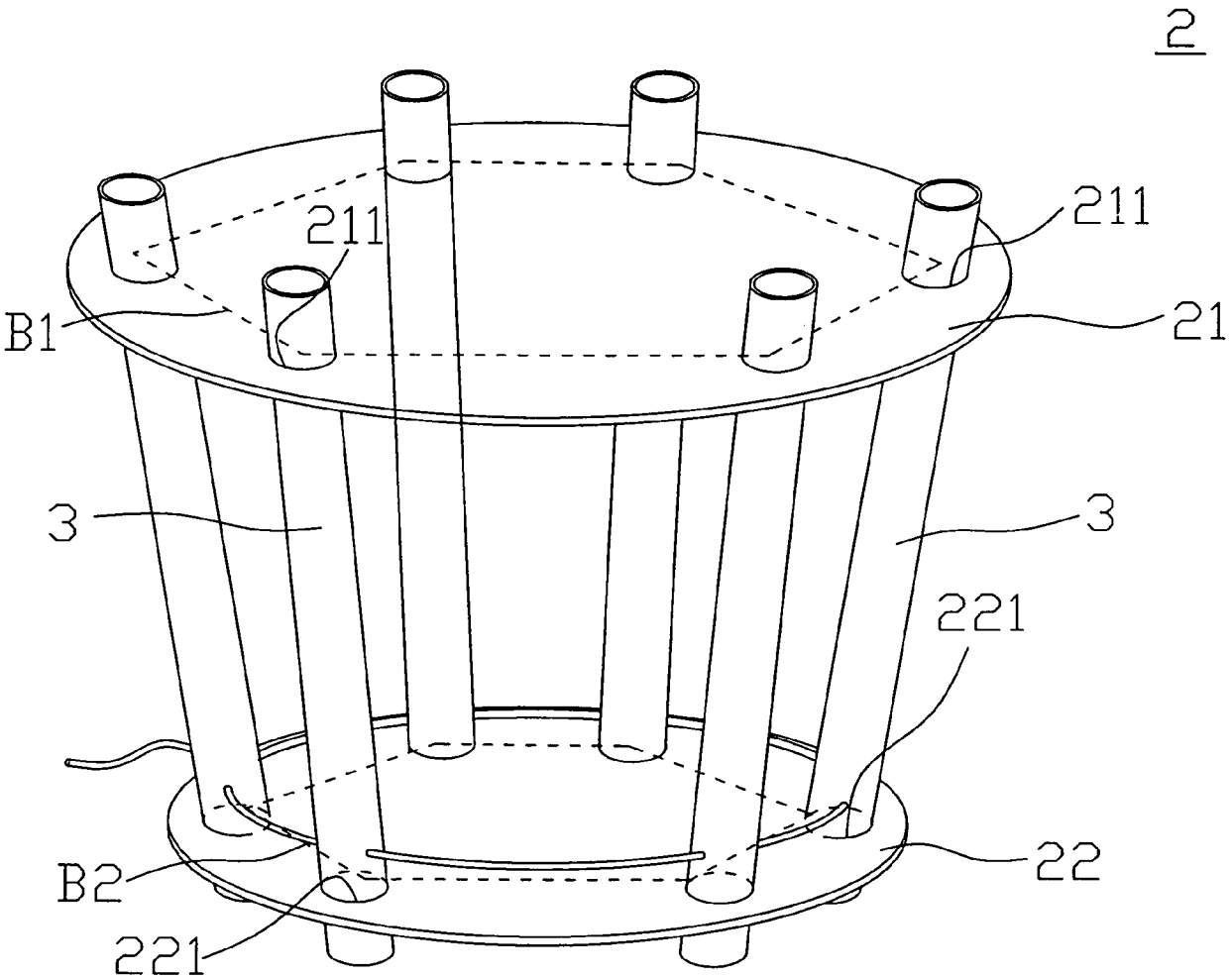
FIG. 5 is a perspective view of a fourth preferred embodiment of the present invention.

Those first and second locating holes 211, 221 respectively provided on the first and the second bearing member 21, 22 in those three preferred embodiments described above are arranged to form a first polygonal B1 and a second polygonal B2 in a fourth preferred embodiment of the present invention as illustrated in FIG. 5. Similarly, multiple pyrotechnic tubes 3 can be each erected at a certain inclination toward a single axis or a double axes.

Figure 6A:
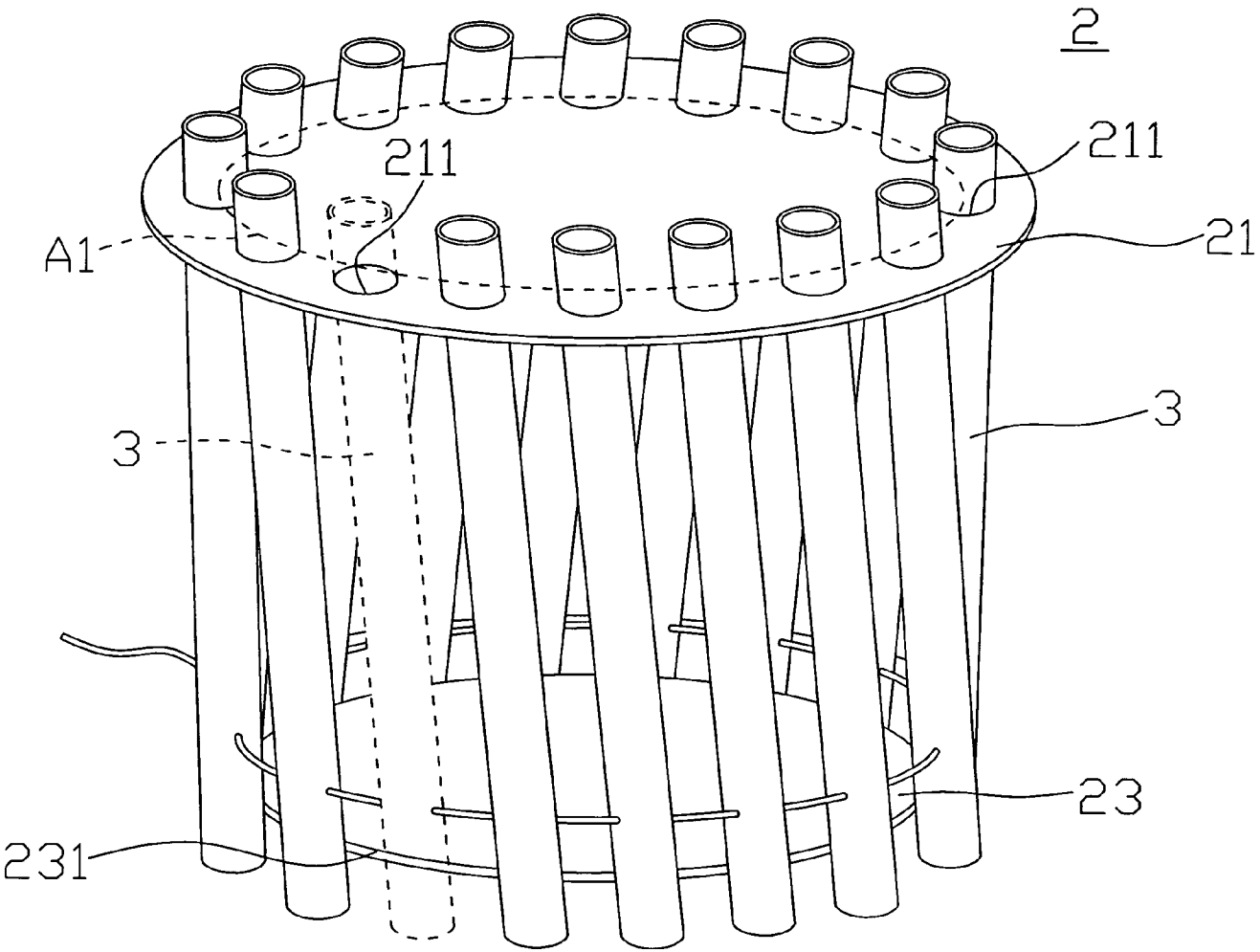
FIGS. 6 (A), and 6(B) are respectively a perspective view and a schematic view of a fifth preferred embodiment of the present invention.
Figure 6B:
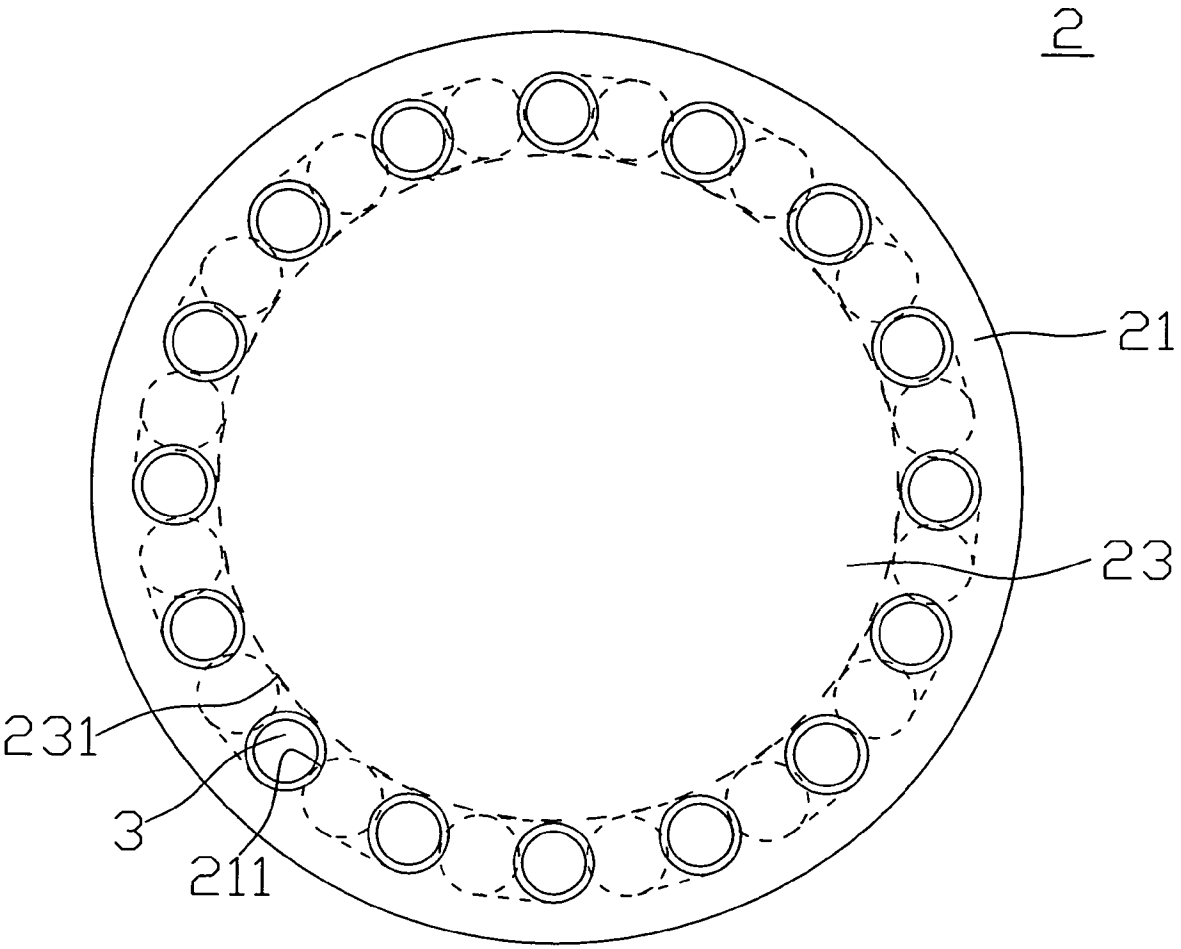

The styling pyrotechnic device may be disposed with one or a plurality of bearing members and a resting member. In a fifth preferred embodiment as illustrate din FIG. 6(A) is provided with a first bearing member 21 and a resting member 23, and multiple bearing portions disposed on the first bearing member 21 and the resting member 23 are made in a construction comprised of multiple first locating holes 211 and resting points 231. Those first locating holes 211 on the first bearing member 21 are arranged to form a first circle A1, and the area of the resting member 23 is identical to that projected by the first circle A1. Each pyrotechnic tube 3 has one end penetrated through the first locating hole 211 and another end resting upon a resting point 231 of the resting member 23. Each resting point 231 is disposed on an outer peripheral to the resting member 23 and on an inner side of the pyrotechnic tube 3. Each pyrotechnic tube 3 is erected at a certain inclination toward a single axis as illustrated in FIG. 6(B) for those pyrotechnic tubes 3 when fired into the skies to produce special styling effects.

Figure 7A:
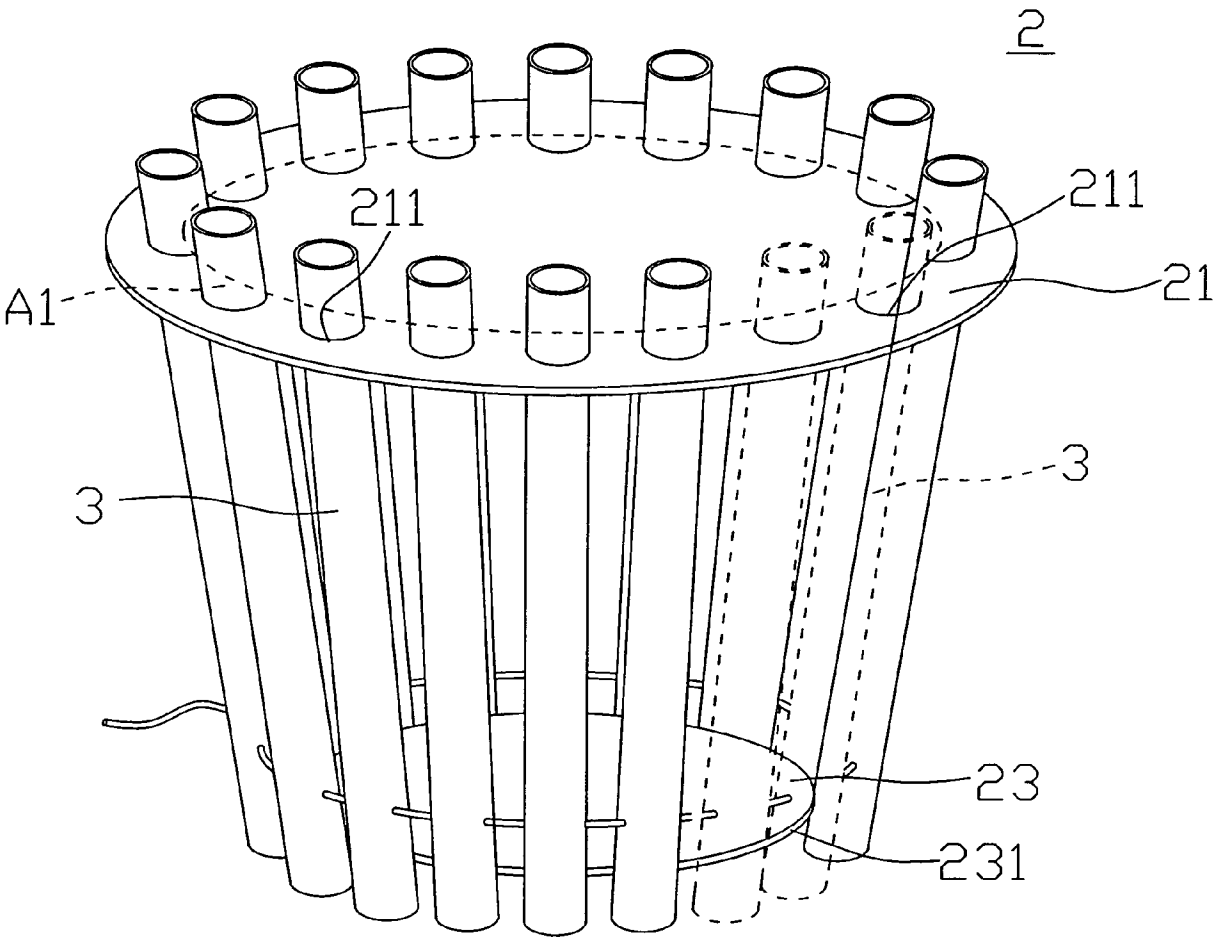
FIGS. 7 (A), 7(B), and 7(C) are respectively a perspective view and two schematic views of a sixth preferred embodiment of the present invention.
Figure 7B:
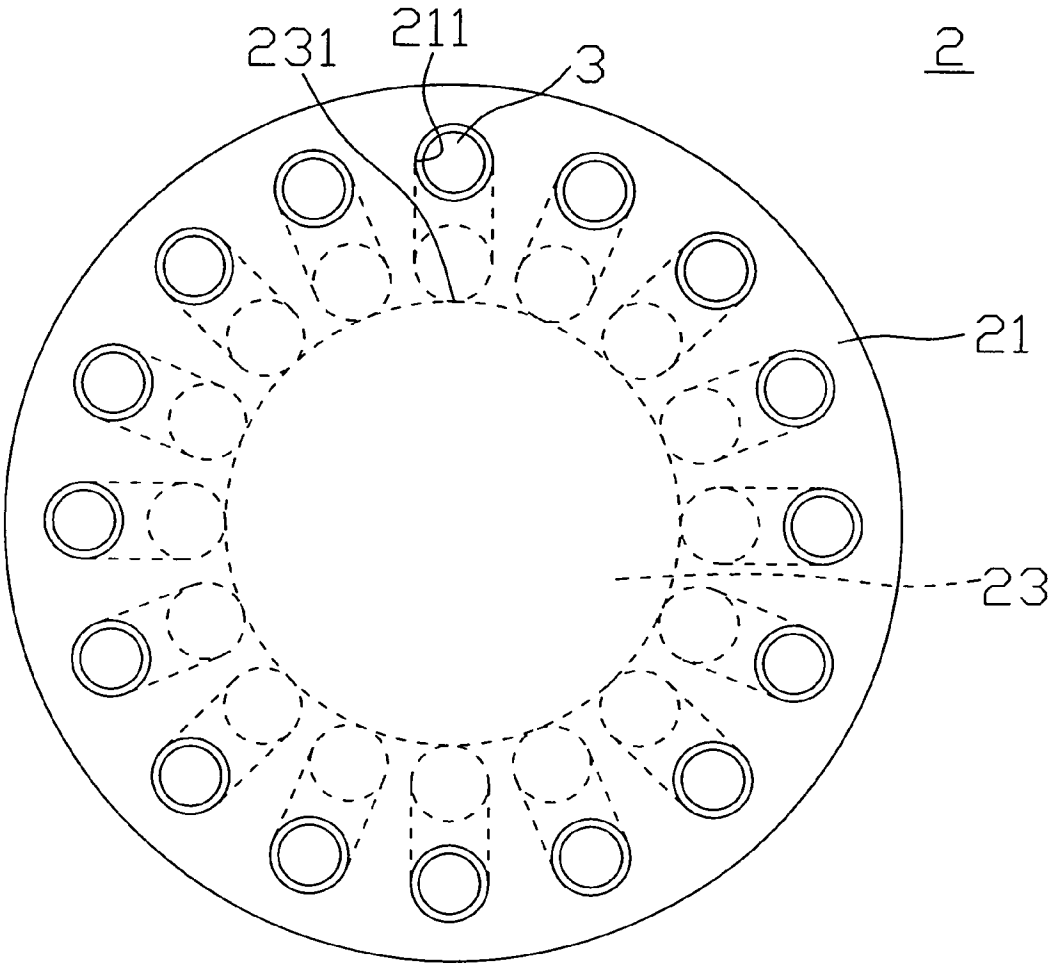
Figure 7C:
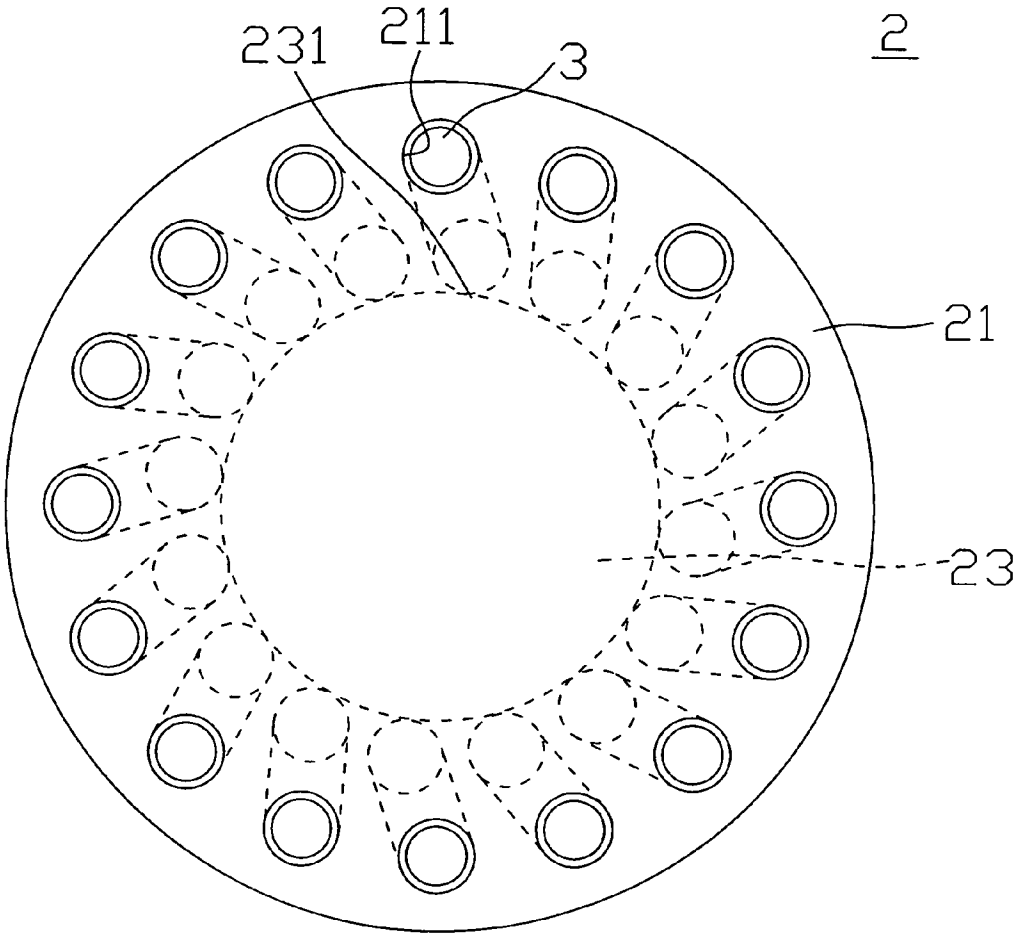

In a sixth preferred embodiment as illustrated in FIG. 7(A), an area of a resting member 23 is smaller than a scope projected by a first circle A1 arranged by multiple first locating holes 211 so that all pyrotechnic tubes 3 are erected at a certain inclination toward a single axis as illustrated in FIG. 7(B); or alternatively a first bearing member 21 or a resting member 23 is turned for a certain angle clockwise or counterclockwise as illustrated in FIG. 7(C) so that each pyrotechnic tube 3 is arranged at an inclination toward double axes.

Figure 8A:
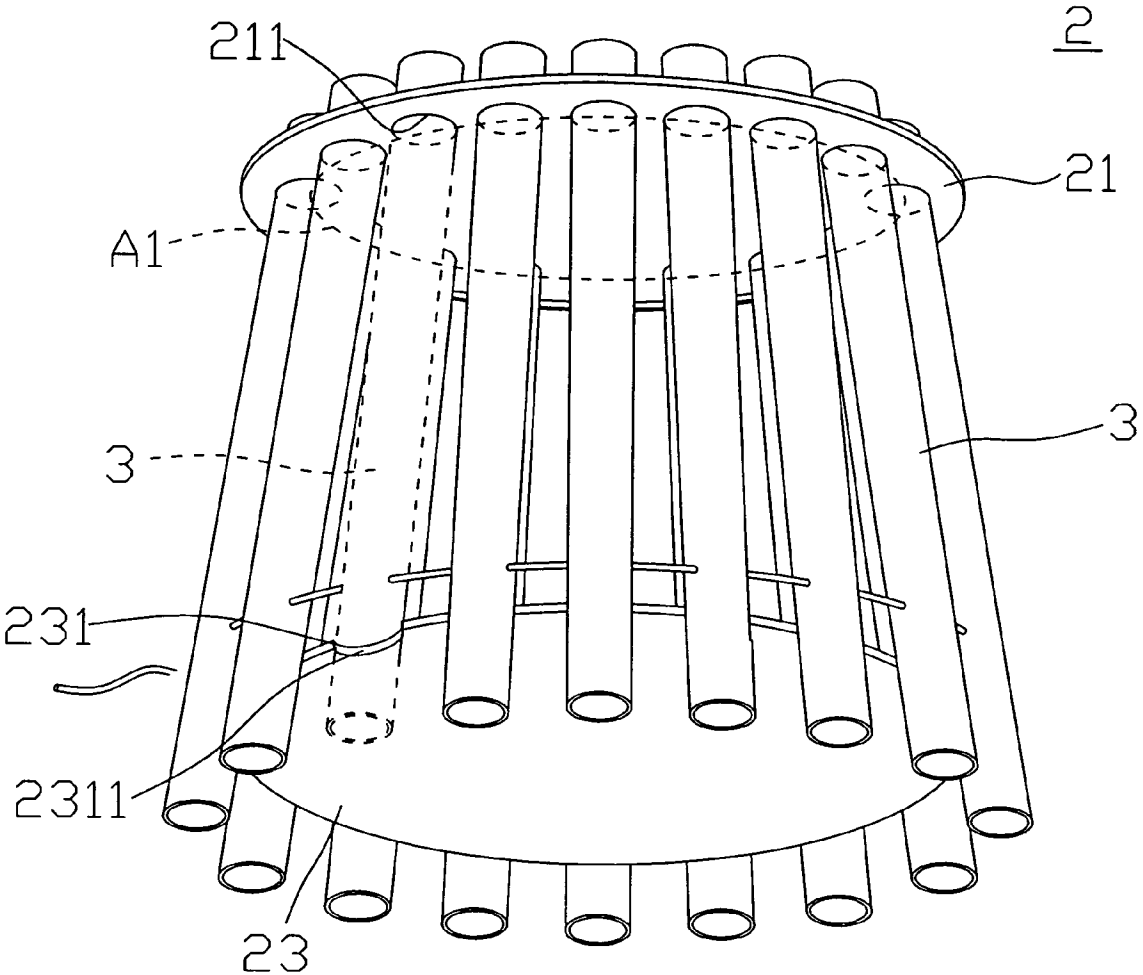
FIGS. 8(A), 8(B), 8(C) and 8(D) are respectively a perspective view and three schematic views of a seventh preferred embodiment of the present invention.
Figure 8B:
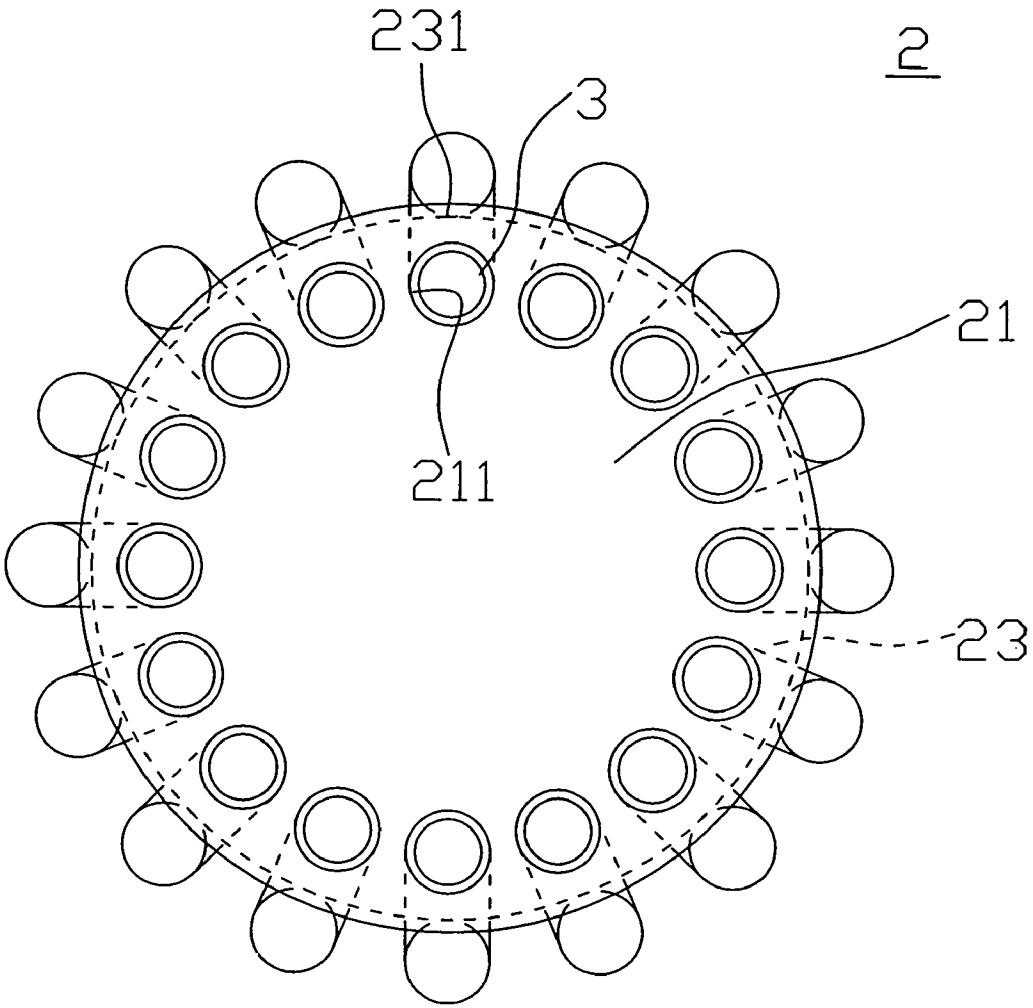
Figure 8C:
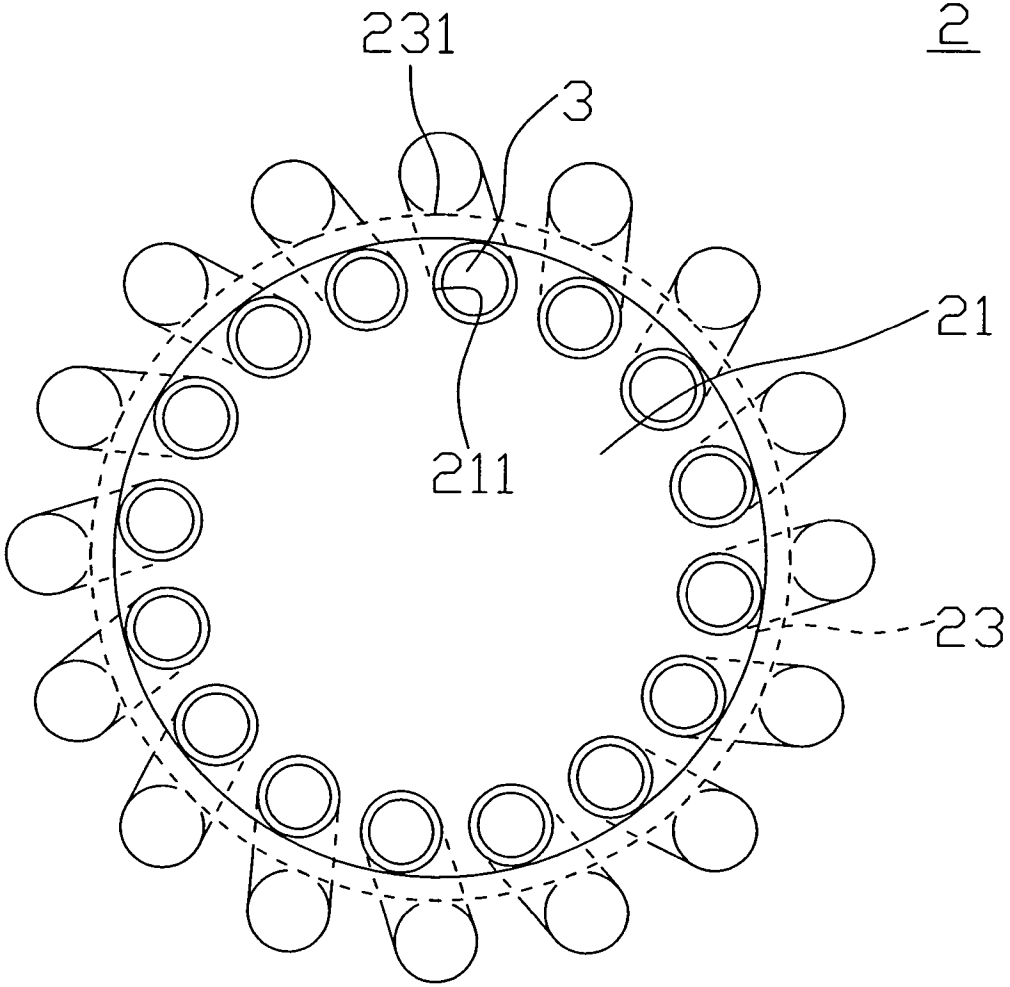
Figure 8D:
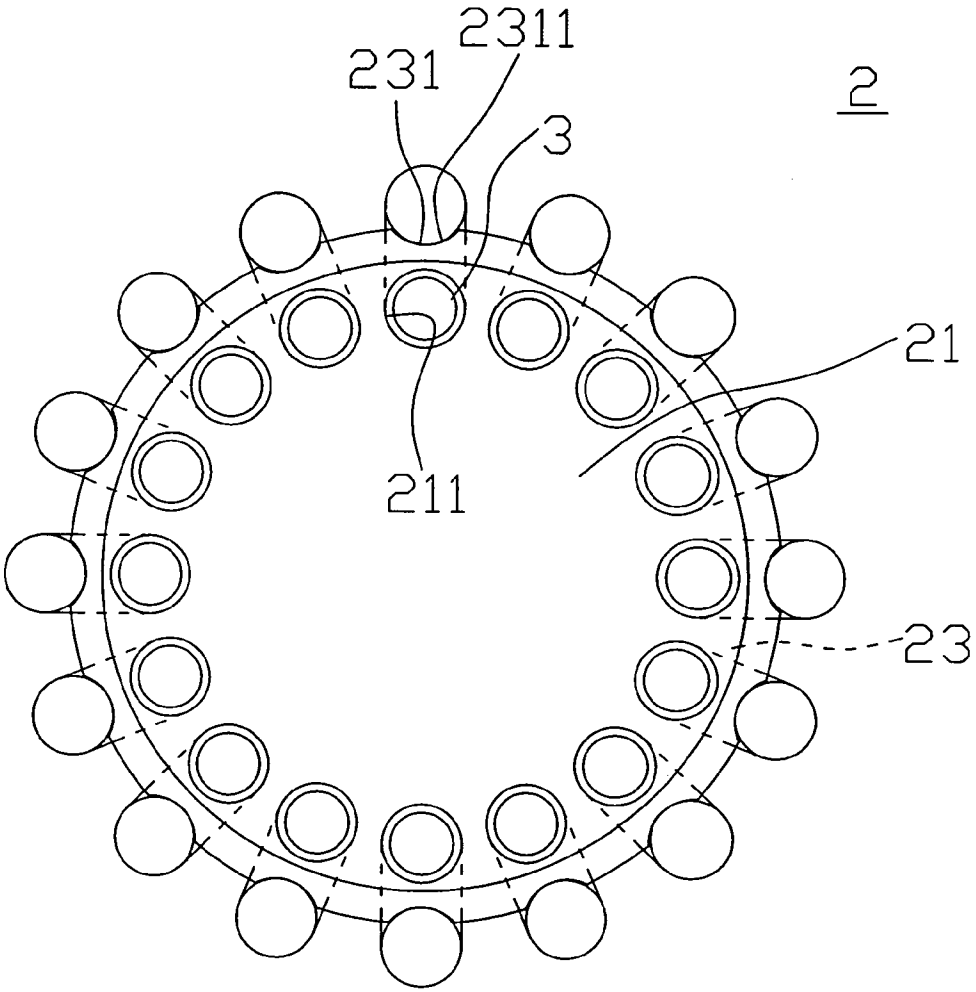

In a seventh preferred embodiment as illustrated in FIG. 8(A), an area of a resting member 23 is greater than a scope projected by a first circle A1 arranged by multiple first locating holes 211 so that all pyrotechnic tubes 3 are erected at a certain inclination toward a single axis as illustrated in FIG. 8(B); or alternatively a first bearing member 21 or a resting member 23 is turned for a certain angle clockwise or counterclockwise, or the resting point for the pyrotechnic tube 3 is rotated for displacement of a certain angle as illustrated in FIG. 8(C) so that each pyrotechnic tube 3 is arranged at an inclination toward double axes. Furthermore, a recess 2311 is formed at each resting point 231 to better secure each pyrotechnic tube 3 in position as illustrated in FIGS. 8(A) and 8(D).

Figure 9:
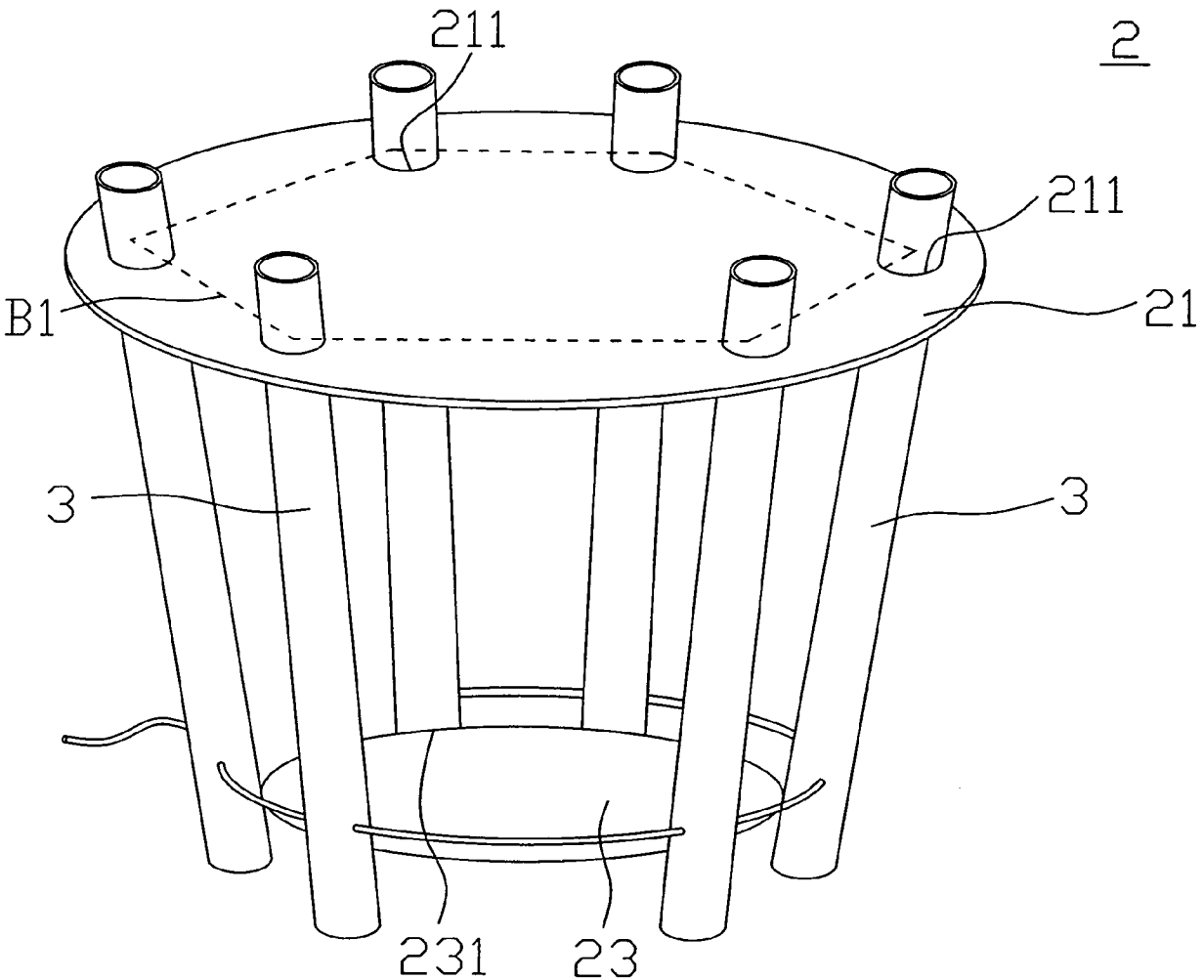
FIG. 9 is a perspective view and two schematic views of an eighth preferred embodiment of the present invention.
Figure 10A:
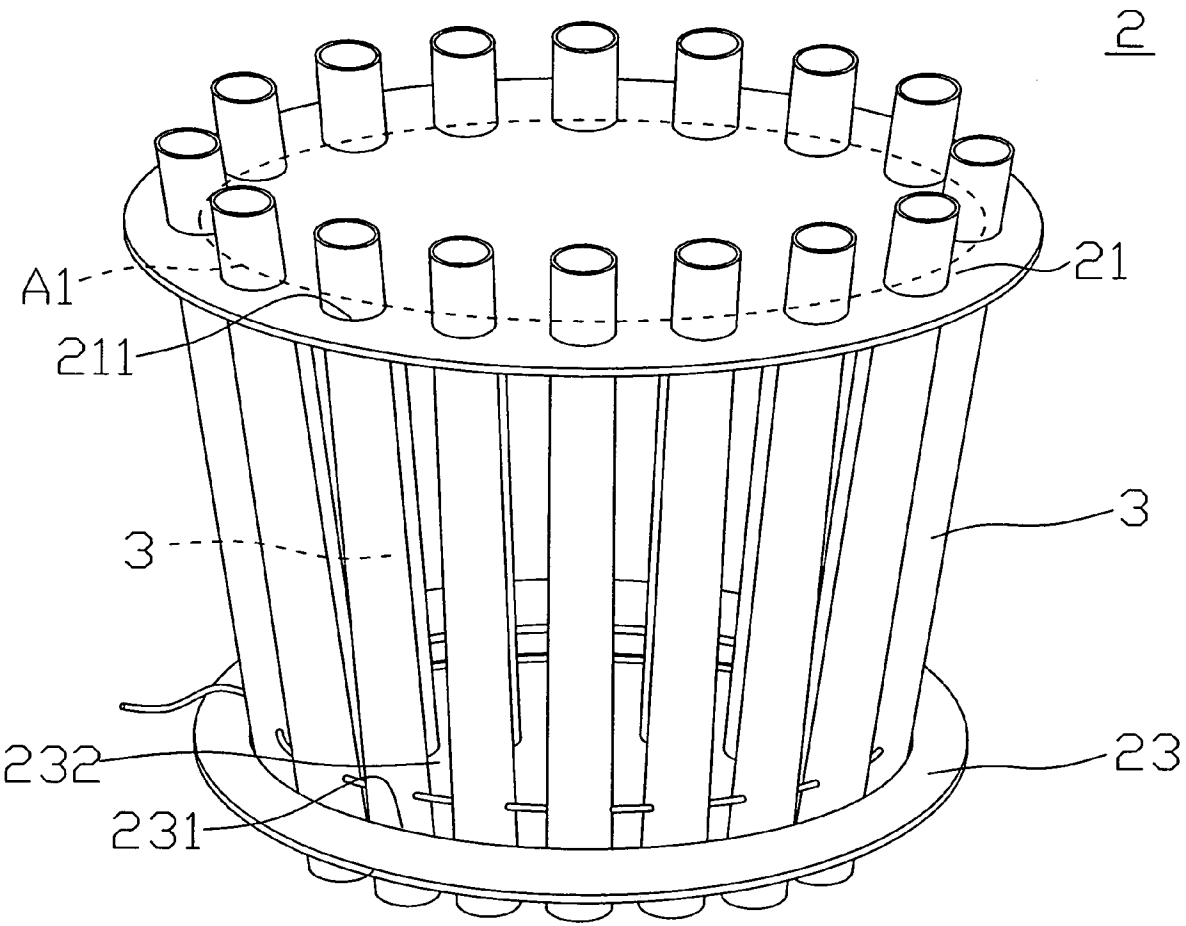
FIGS. 10(A) and 10(B) are two schematic views of a ninth preferred embodiment of the present invention.
Figure 10B:
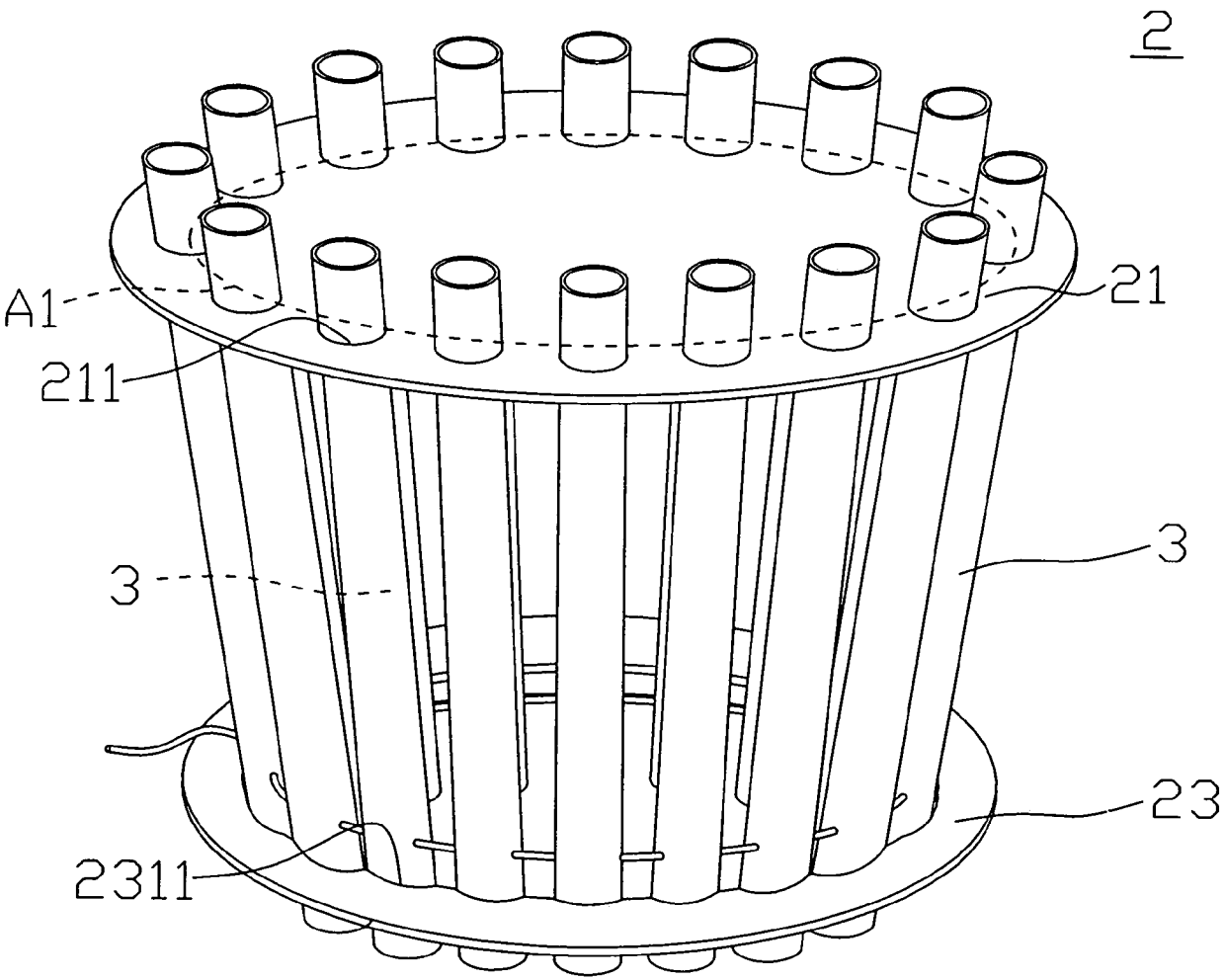

Those first locating holes 211 on the first bearing member 21 in any of those preferred embodiments described above may be arranged to form a polygon B1 in an eighth preferred embodiment as illustrated in FIG. 9 to achieve the same purpose of having those pyrotechnic tubes 3 to be erected at a certain inclination toward a single axis or a double axes. In a ninth preferred embodiment illustrated in FIG. 10(A), a hollowed area 232 is disposed to each resting member 23 at where close to the center of the resting member 23 and externally to each pyrotechnic tube for each of the fifth, the sixth, the seventh, and the eighth preferred embodiments described above for those pyrotechnic tubes 3 to form an arrangement at different angle. Again, the recess 2311 is disposed to the resting point as illustrated in FIG. 10(B) to better secure each pyrotechnic tube 3 in position.

Figure 11:
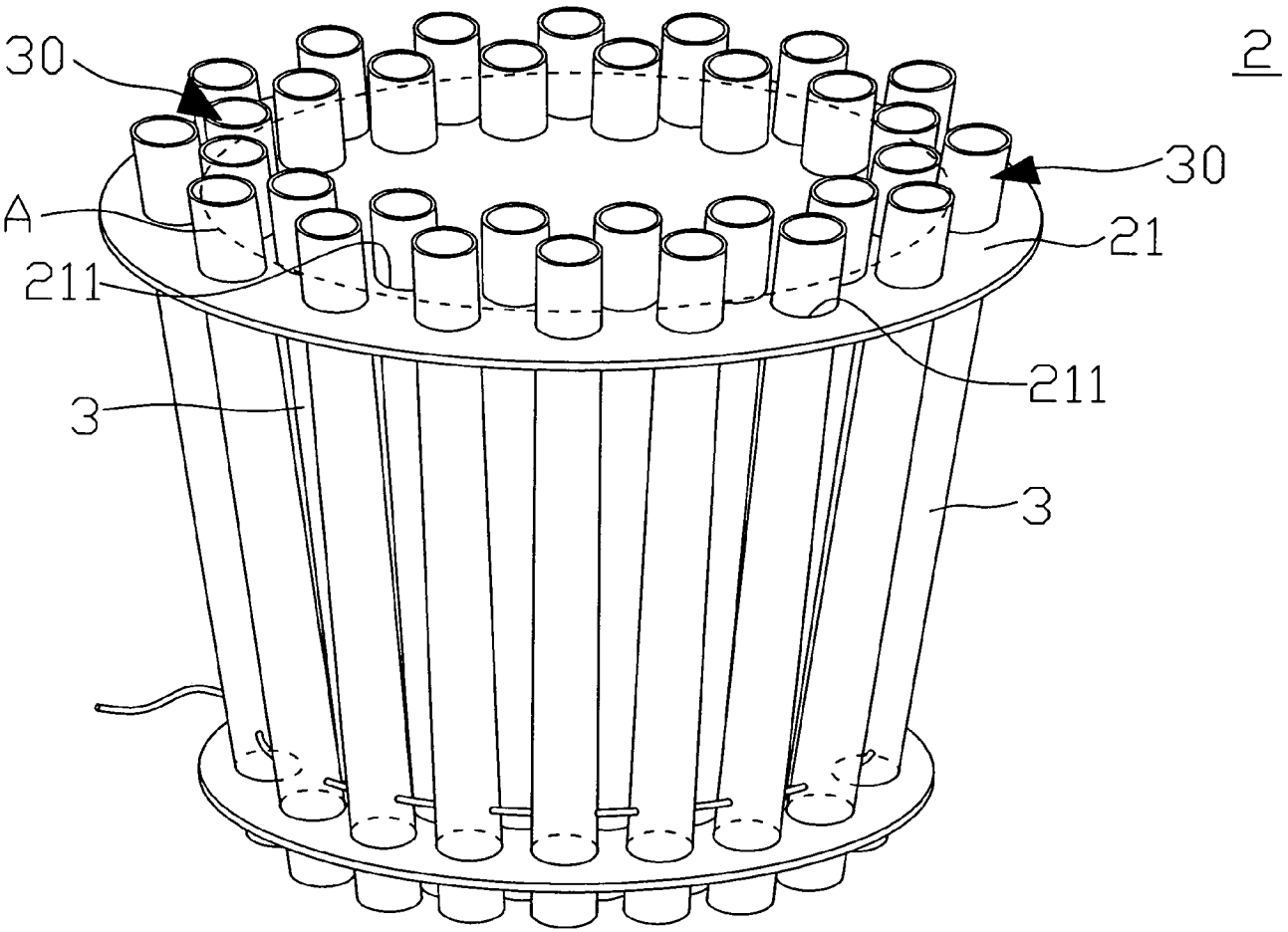
FIG. 11 is a perspective view of a tenth preferred embodiment of the present invention.
Figure 12:
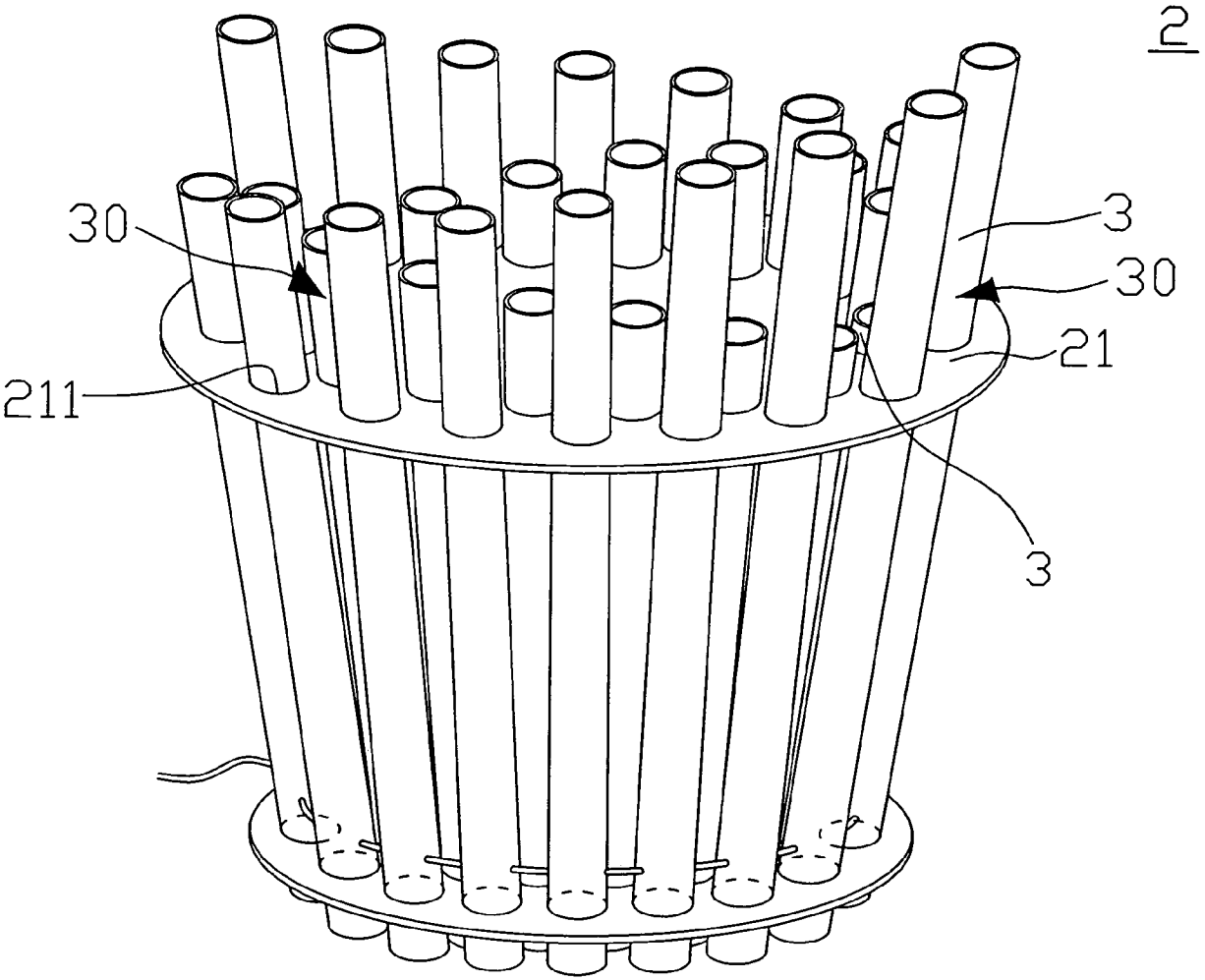
FIG. 12 is a perspective view of an eleventh preferred embodiment of the present invention.

Furthermore yet, those locating holes disclosed in any of those preferred embodiments described above are arranged in a radiant form in a tenth preferred embodiment as illustrated in FIG. 11; wherein multiple patterns A are arranged in a radiant form by those first locating holes 211 on the first bearing member 21 with each to be inserted with a pyrotechnical tube 3 in identical length in the tenth preferred embodiment or in different lengths in an eleventh preferred embodiment illustrated in FIG. 12 to form multiple pyrotechnic tube rows 30. Those pyrotechnic tube rows 30 may be arranged in a ladder with the row comprised of the longest pyrotechnic tubes 3 to be arranged next to another row comprised of the shortest pyrotechnic tubes 3 so to produce various styling effects once all pyrotechnic tube rows 30 are fired into the skies.

Figure 13A:
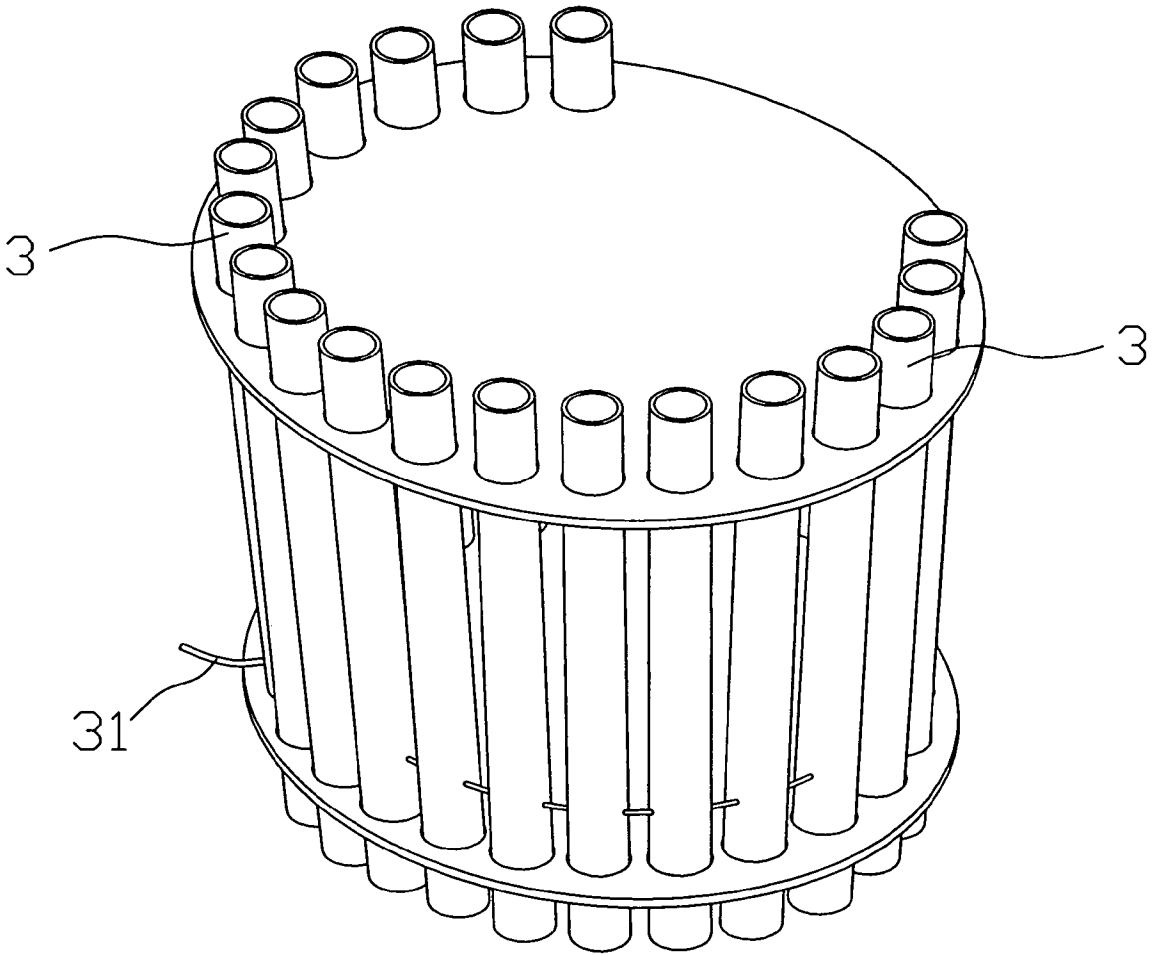
FIGS. 13(A) and 13(B) are two perspective views of a twelfth preferred embodiment of the present invention.
Figure 13B:
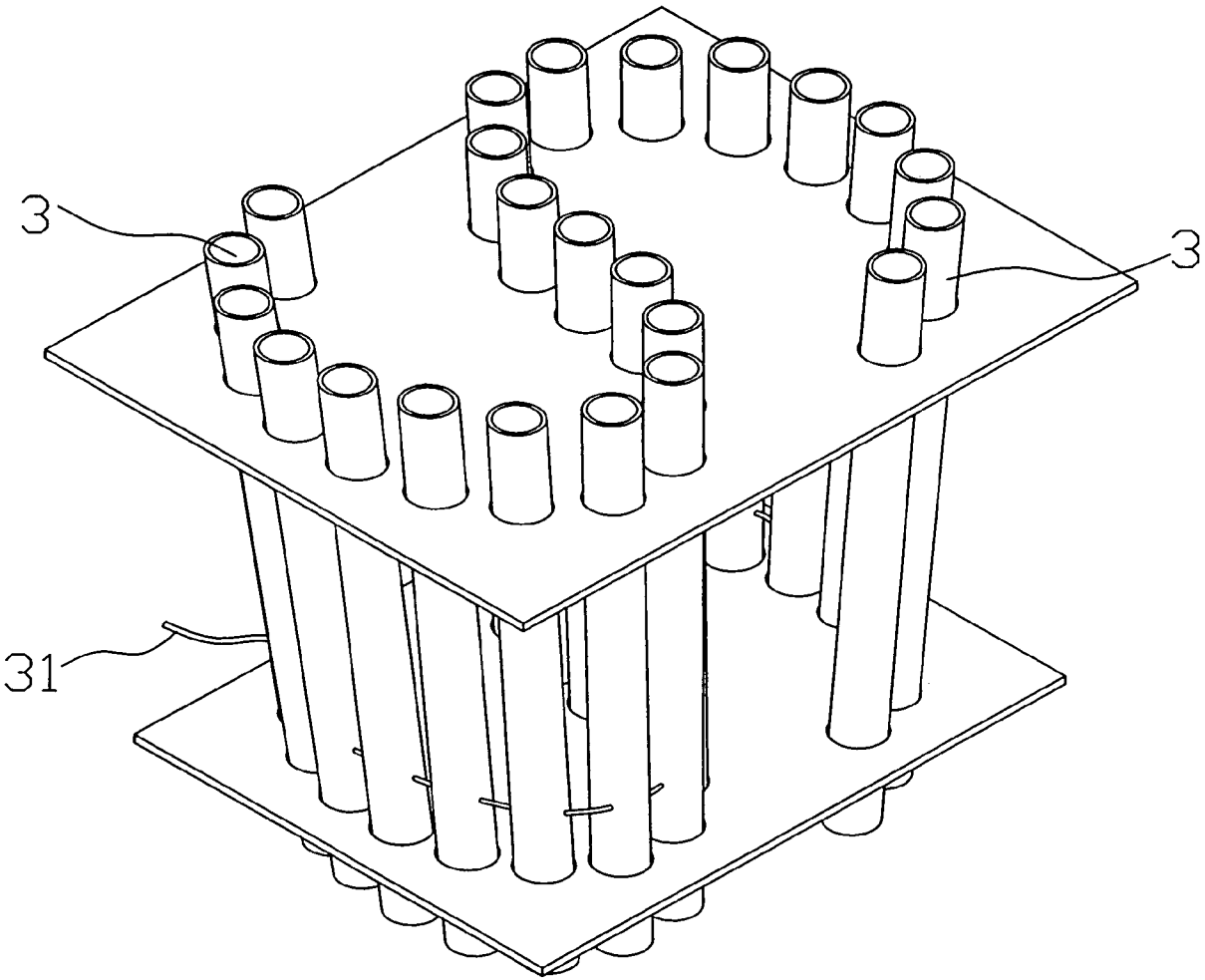
Figure 14:
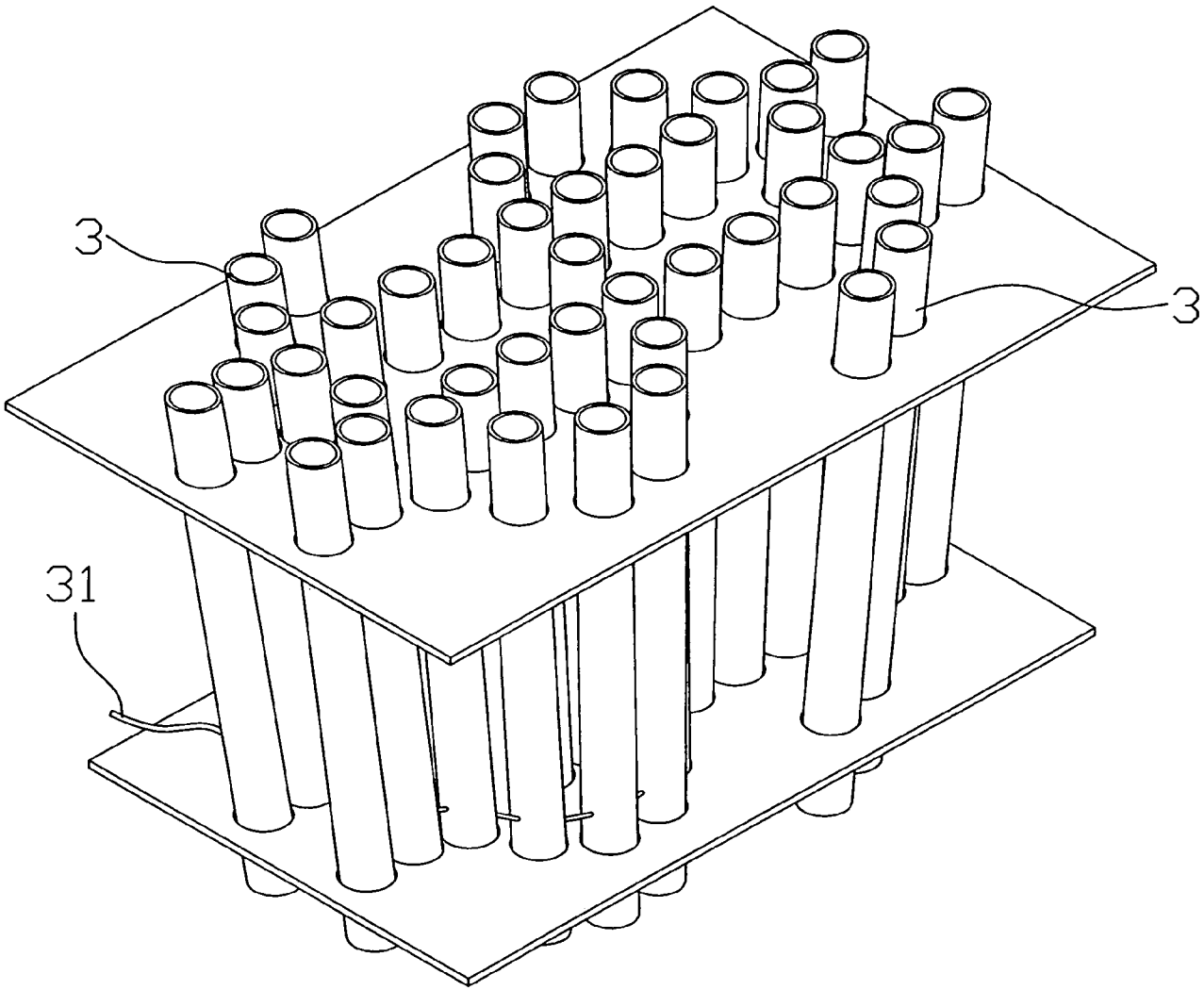
FIG. 14 is a perspective view of a thirteenth preferred embodiment of the present invention.
Figure 15:
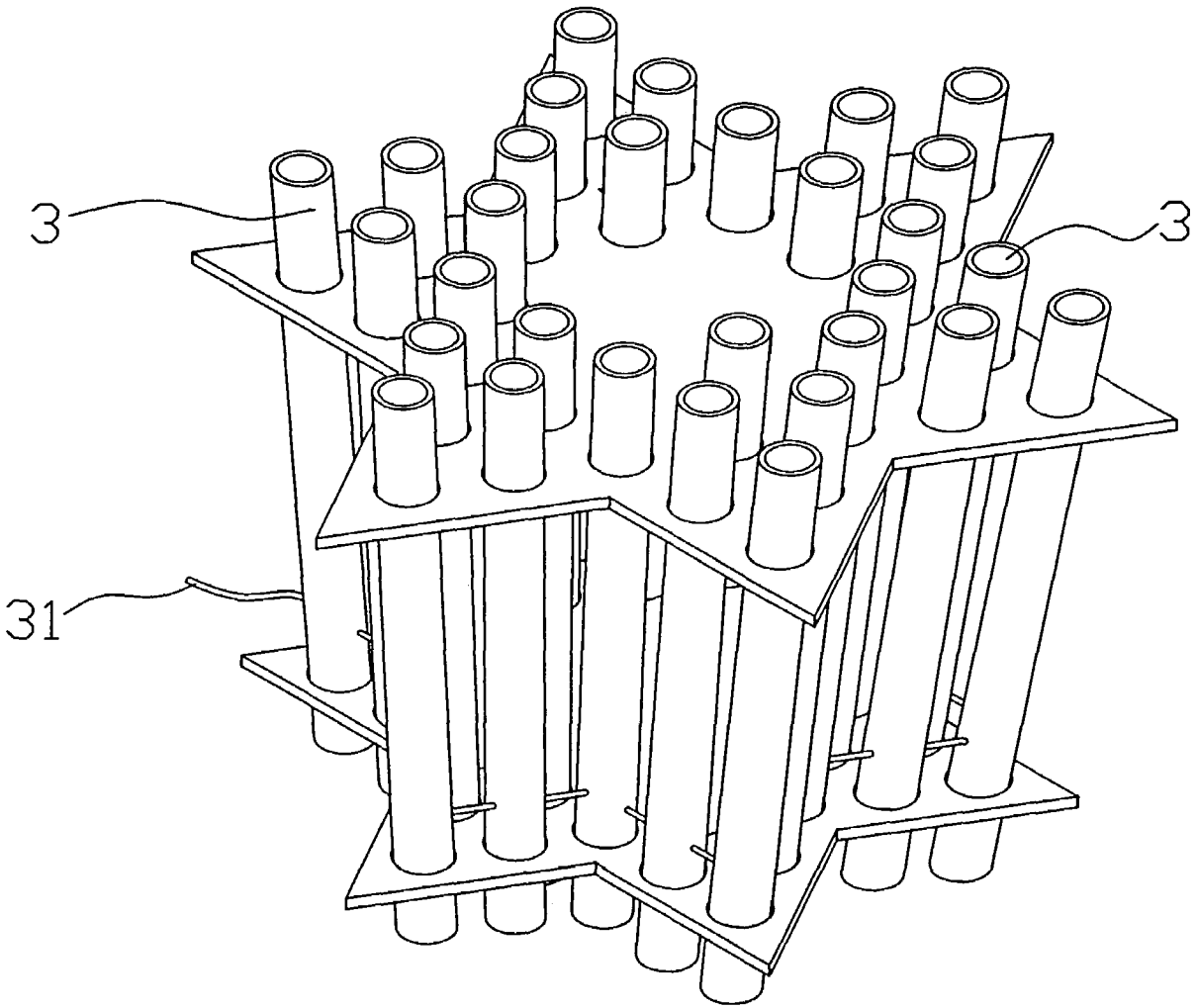
FIG. 15 is a perspective view of a fourteenth preferred embodiment of the present invention.

Those pyrotechnic tubes may be arranged in different letters, patterns, or symbols. Multiple pyrotechnic tubes 3 are arranged to indicate a letter of C or S in a twelfth preferred embodiment as illustrated in FIGS. 13(A) and 13(B); or a symbol of "$" in a thirteenth preferred embodiment as illustrate din FIG. 14; or an aster in a fourteenth preferred embodiment as illustrated in FIG. 15. All pyrotechnic tubes 3 are connected with a blasting fuse 31 to be ignited in sequence to produce styling effects of the letter, pattern or symbol in the skies.

The prevent invention provides an improved structure of a styling pyrotechnic device, and the application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A styling pyrotechnic device comprising a first bearing member and a second bearing member, each bearing member being disposed with multiple bearing portions, the first bearing member being disposed with multiple first bearing portions and the second bearing member being disposed with multiple second bearing portions, wherein the first bearing portions are arranged to define a first imaginary circle or a first imaginary polygon and the second bearing portions are arranged to define a second imaginary circle or a second imaginary polygon; and multiple pyrotechnic tubes with both ends of each pyrotechnic tube being respectively secured on the bearing portions of each bearing member, so that the first and second bearing members are held substantially parallel to each other by the pyrotechnic tubes and form an integral structure with the pyrotechnic tubes; each pyrotechnic tube being inserted first into the first bearing portion of the first bearing member and then into the second bearing portion of the second bearing member in a fashion not directly on the same vertical line to the first bearing portion but the one next to it; and wherein a total length of a periphery of the first imaginary circle or the first imaginary polygon is different from that of a periphery of the second imaginary circle or the second polygon so that each pyrotechnic tube is erected at an inclined angle towards a single axis, wherein the first bearing portions have the same size and shape with one another and the second bearing portions have the same size and shape with one another, with the first bearing portions and the second bearing portions having the same size and shape.

2. The styling pyrotechnic device as claimed in claim 1, wherein each of the first bearing portions defines a first locating hole and each of the second bearing portions defines a second locating hole.

3. The styling pyrotechnic device as claimed in claim 1, wherein each of the first bearing portions defines a locating hole and each of the second bearing portions defines a resting point.

4. The styling pyrotechnic device as claimed in claim 3, wherein each resting point on the second bearing member is disposed on an outer periphery of the second bearing member and receiving a corresponding pyrotechnic tube.

5. The styling pyrotechnic device as claimed in claim 3, wherein the second bearing member defines at its center a hollowed area; each resting point having a recess disposed at the inner edge of the bearing member facing the hollowed area and receiving a corresponding pyrotechnic tube.

6. The styling pyrotechnic device as claimed in claim 1, wherein the pyrotechnic tubes are arranged to indicate a letter, pattern, or symbol.

7. The styling pyrotechnic device as claimed in claim 1, wherein the pyrotechnic tubes are arranged to indicate a letter, pattern, or symbol and connected together using a blasting fuse.

8. The styling pyrotechnic device as claimed in claim 1, wherein one of the first bearing member and the second bearing member is turned clockwise or counterclockwise through a certain angle, so that each pyrotechnic tube is arranged at an inclination toward double axes.

* * * * *